US006226956B1

(12) United States Patent
Davis et al.

(10) Patent No.: US 6,226,956 B1
(45) Date of Patent: May 8, 2001

(54) METHOD OF INSTALLING A RAIN WATER DIVERTER SYSTEM FOR DECK STRUCTURES

(76) Inventors: Richard A. Davis, 7025 James Ave. South, Richfield, MN (US) 55423; LeRoy A. Prohofsky, 8983 Ferndale La., Eden Prairie, MN (US) 55357

( * ) Notice: Subject to any disclaimer, the term of this patent is extended or adjusted under 35 U.S.C. 154(b) by 0 days.

(21) Appl. No.: 09/612,879

(22) Filed: Jul. 10, 2000

Related U.S. Application Data

(62) Division of application No. 09/365,794, filed on Aug. 3, 1999.
(60) Provisional application No. 60/095,147, filed on Aug. 3, 1998.

(51) Int. Cl.[7] ..... E04F 21/00
(52) U.S. Cl. ..... 52/745.06; 52/11; 52/14; 52/22
(58) Field of Search ..... 52/11–15, 22, 52/302.1, 745.06, 745.07, 741.1

(56) References Cited

U.S. PATENT DOCUMENTS

| | | | |
|---|---|---|---|
| 1,562,346 | 11/1925 | Leidich | 52/11 |
| 4,065,883 | 1/1978 | Thibodeau | 52/11 |
| 4,129,967 | 12/1978 | Barlow | 52/15 |
| 4,663,894 | 5/1987 | LaRoche et al. | 52/15 |
| 4,789,116 | 12/1988 | Eftestol | 52/14 |
| 4,858,399 | 8/1989 | Salato, Jr. | 52/97 |
| 4,860,502 | 8/1989 | Mickelsen | 52/11 |
| 5,511,351 | 4/1996 | Moore | 52/302.1 |

*Primary Examiner*—Carl D. Friedman
*Assistant Examiner*—Naoko Slack
(74) *Attorney, Agent, or Firm*—Nikolai, Mersereau & Dietz, P.A.

(57) ABSTRACT

A combination of versatile and inexpensive elements are combined on site to create an impermeable assembly which collects water falling through a grating or cracks between adjacent boards of a deck and completely drains it to one or more points at a selected edge. The impermeable assembly is comprised of a plurality of peaks and valleys configured to simplify installation, conserve headroom and provide an aesthetically pleasing finished surface. In a first embodiment, a collector collects the water falling through cracks between boards spanning the space between adjacent joists from which it drains transversely to a gutter positioned beneath the joists. The gutter drains the water longitudinally to the perimeter of the deck.

3 Claims, 31 Drawing Sheets

METHOD OF INSTALLING A RAIN WATER DIVERTER SYSTEM FOR DECK STRUCTURES

CROSS-REFERENCE TO RELATED APPLICATION

The present application is a divisional of copending application Ser. No. 09/365,794, filed on Aug. 3, 1999, which application constitutes a utility application for Letters Patent to that certain Provisional Application Serial No. 60/095,147, filed Aug. 3, 1998.

FIELD OF THE INVENTION

The present invention relates generally to elevated decks for residential buildings, and more particularly to a rain water collection system for the underside of such decks to maintain a dry space there beneath.

DISCUSSION OF THE PRIOR ART

Exterior structures, such as decks, gratings and walkways, are typically designed to allow water to fall through the spacing between adjacent decking boards or other apertures. It may be desirable to otherwise collect this water to thereby make the space under such surfaces dry. The object of the present invention is to provide an impermeable assembly which may be easily mounted to the underside of existing decks, gratings or walkways, which collects and routes rain water to a discharge point while maintaining the area under the deck free of dripping water.

The closest prior art of which we are aware is the Moore U.S. Pat. No. 5,511,351. The patent describes a water collection and drainage system that is adapted to be attached to the underside of a residential deck and comprises flexible sheets that are affixed to deck joists so that they present concaved upper surfaces and convexed lower surfaces. While this structure may be suitable for use in climates that are not subject to freezing, the underdeck water collection system described in the Moore patent is unsuitable for use in freezing climes. In freezing climes, water from melting snow on the deck will fall between adjacent deck boards onto the concave collector structure suspended therebeneath. When out of the rays of the sun, the temperature beneath the deck very often is below freezing temperature, resulting in a build-up of ice thereon. Over a period of several days of thawing and freezing temperatures, the weight of the ice can cause the suspension structure to fail.

Another drawback of the apparatus described in the Moore '351 patent is that the flexible connectors extend below the bottom of the deck joists, thereby limiting the head room under the deck.

It is a further object of the invention that the impermeable assembly be comprised of a versatile system of components which may be easily assembled on site by a single person to form an aesthetically pleasing surface beneath the deck which drains all water to the perimeter of a deck, grating or walkway and which can be used in climates where frequent freezing and thawing occurs.

It is a further object of the invention to minimize the encroachment of the headroom space beneath the deck by the impermeable assembly.

It is a further object of the invention that at least some of the elements of the impermeable assembly be removable for maintenance and repair.

SUMMARY OF INVENTION

The invention will be taught with respect to residential decks which are typical of other exterior structures which could benefit from the invention. FIG. 1 shows a typical residential deck comprised of joists 10, end plates 12 and deck boards 14. Actual decks have a wide variety of sizes and shapes, however, between centers, the joist-to-joist spacing is typically 16", and if not that then typically 24'. The description of various embodiments will be with orienting reference to a typical deck structure. As used herein longitudinal refers to the orientation along a line parallel to the deck joist while transverse refers to the orientation along a horizontal line perpendicular to the deck joist. With reference to the boundary edges of the deck the side edges are longitudinal while the front and back edges are transverse.

FIG. 2(*a*) shows, conceptually, the surface contour of an impermeable water collection assembly constructed according to certain aspects of the disclosed embodiments. FIG. 2(*b*) shows the end view of the surface of FIG. 1(*a*). The surface is comprised of periodic peaks and valleys. Water flows transversely into the gutter and then longitudinally to the perimeter of the deck. By controlling the slope or pitch of the assembly, water may be directed to flow to a single edge where it may undergo further collection by means which are not part of this invention. The realization of an impermeable assembly suspended to the underside of an existing structure presents problems not found in art which might otherwise be considered related. For example, prior art impermeable 15 roofing systems which are applied to the top side of an underlying supporting structure are not adaptable to a suspended system. Further, the prior art structure and methods used to realize a permeable suspended ceiling are not amenable to modification which would render them impermeable. The subject invention realizes the impermeable surface of FIG. 2(*a*) in a novel way which results in an attractive, yet inexpensive system which is exceptionally easy to install and to maintain beneath decks and walkways. In certain of the embodiments disclosed herein, the impermeable assembly is sectioned according to FIG. 2(*c*). Collectors 20 are convexed on their upper surface to define peak regions which direct water transversely to their side edges and, thus, into inclined gutters 22 which comprise the valley regions directing water longitudinally to the edge of the deck. Gutters 22 are disposed directly beneath deck joists 10 and are attached thereto by various means. Collectors 20 are attached, or otherwise constrained so that their side edges are vertically overlapping with respect to gutters 22 to prevent leakage and to thus render the resulting assembly water impermeable for a typical rain shower. "Impermeability", as used herein, does not require a watertight seal which would withstand gale force winds even though this capability is present in certain embodiments. Collector 20 may have an inverted V or a more crowned convex shape which provides useful stiffness, allowing relatively thin and inexpensive materials to withstand the stress of wind when so shaped. The crowned shape is achieved without loss of headroom in that the crown resides in the cavity between adjacent joists.

Thus, in a general sense, the present invention comprises rain water collection apparatus that is adapted to be affixed to an underside of an elevated, water-pervious, deck structure of the type where a plurality of parallel, regularly-spaced, longitudinally extending joists project from a building structure and with a plurality of deck boards secured to an upper edge surface of the joists and which extend generally transversely to the joists. The collection apparatus comprises resilient, water-impervious, rectangular collector sheets having a predetermined length dimension and a width dimension between opposed side edges that is greater than the regular spacing between adjacent ones of the joists. Means are provided for mounting the collector sheets between adjacent ones of said joists for supporting the sheets in a space between adjacent joists with an upper surface of the sheets convex and a lower surface of the sheets concave. A plurality of gutter members are attachable to the joists and span the bottom edge of the joists to vertically overlap side edges of the collector sheets, such that water seeping between adjacent deck boards falls on the upper convex surface of the collector sheets and then flows laterally into the gutter members disposed beneath the side edges of the collector sheets. The gutter members are at a pitch such that the water therein flows to the outer perimeter of the deck structure.

BRIEF DESCRIPTION OF THE DRAWINGS

The foregoing features, objects and advantages of the invention will become apparent to those skilled in the art from the following detailed description of the preferred embodiments, especially when considered in conjunction with the accompanying drawings in which like numerals in the several views refer to corresponding parts.

FIG. 3(*b*) is a partial perspective view of a mounting bracket for connecting a gutter component to a joist;

FIG. 3(*c*) is an end edge view of the mounting bracket affixed to a joist;

FIG. 3(*d*) is an end view of a gutter design suitable for the outer side edges of the decks;

FIG. 3(*e*) is a cross-sectional view of an alternative embodiment for a mounting bracket for connecting a gutter component to a joist;

FIG. 3(*f*) is a front view of the mounting bracket of FIG. 3(*e*);

FIG. 3(*g*) is a front elevation showing a different style of mounting bracket suspending a pair of collectors and a gutter from a joist;

FIG. 3(*h*) shows the mounting bracket of FIG. 3(*g*) when used to suspend a specially designed gutter from a rim joist;

6

Figure 7A:
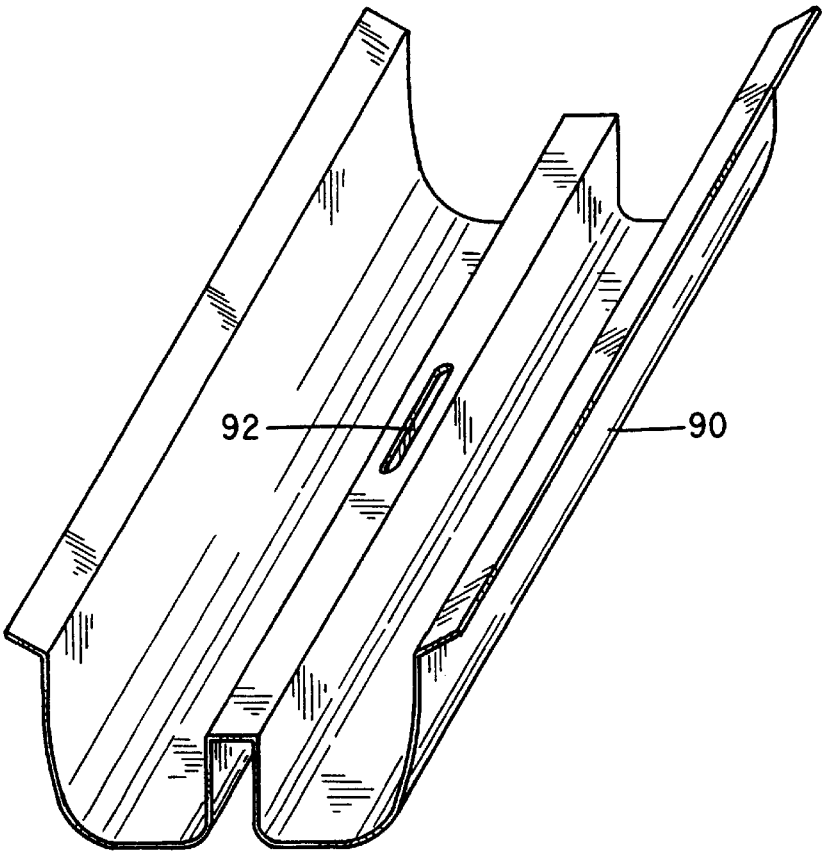
Figure 7B:
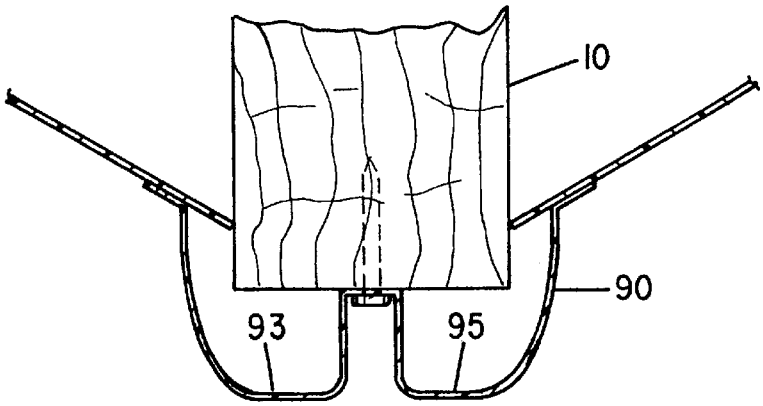
Figure 8A:
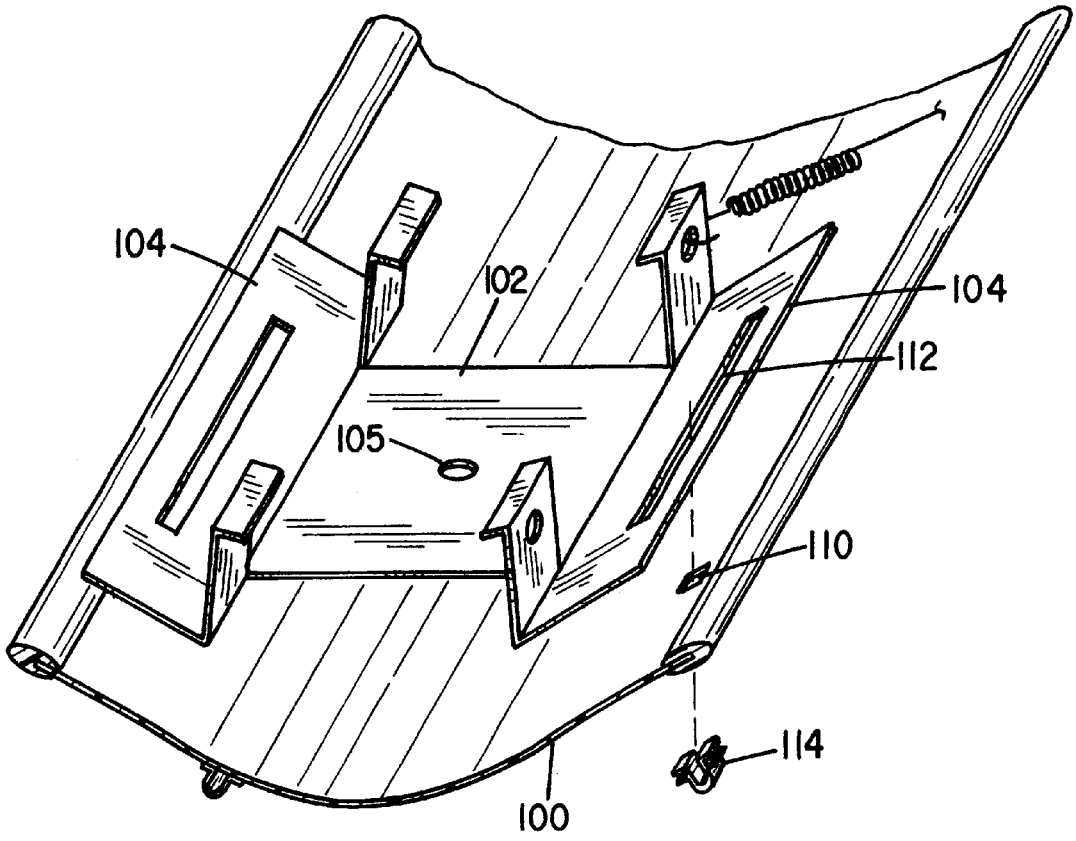
Figure 8B:
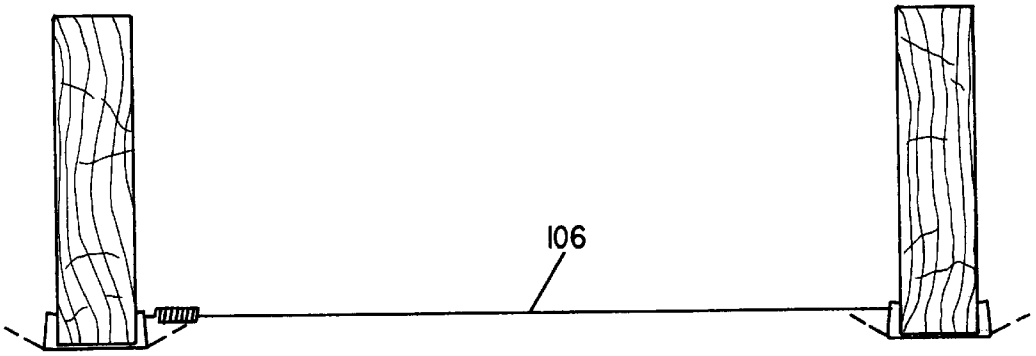
Figure 8C:
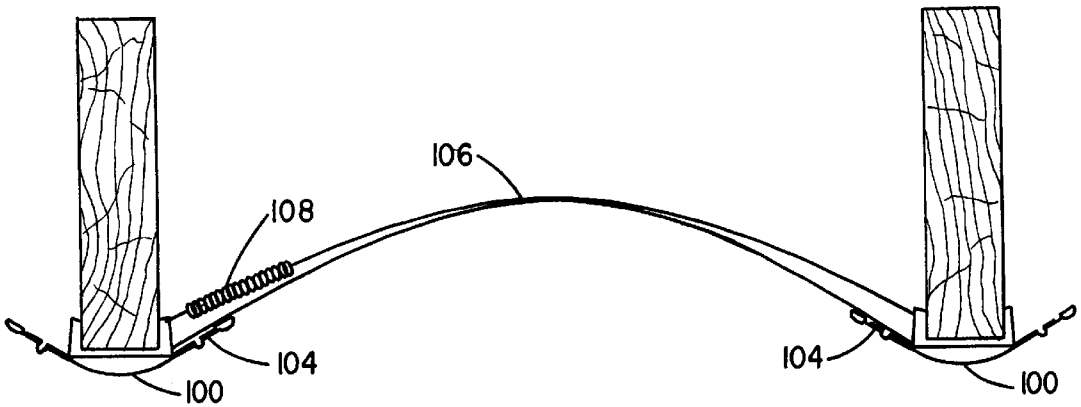
Figure 8D:
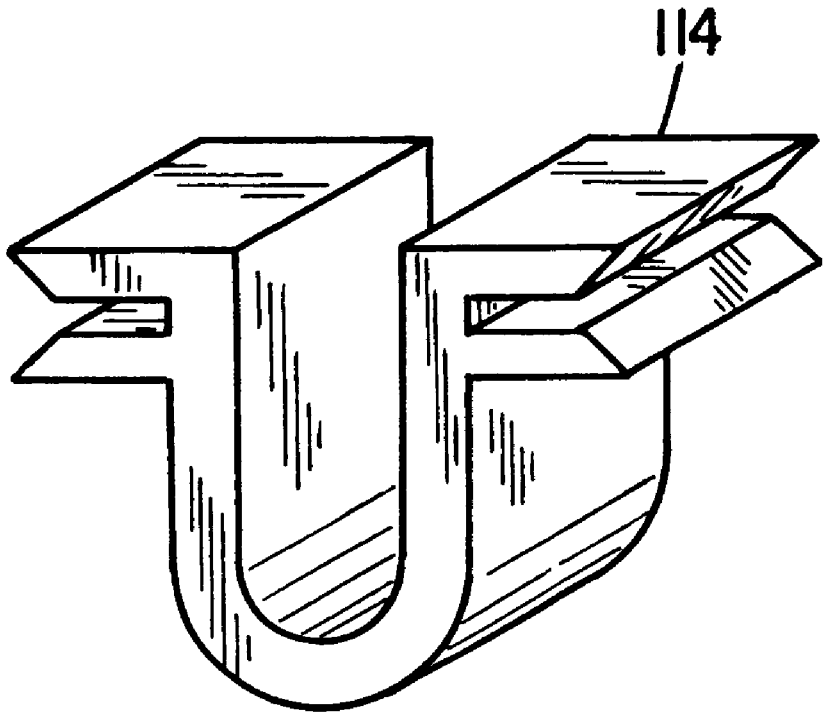
Figure 9B:
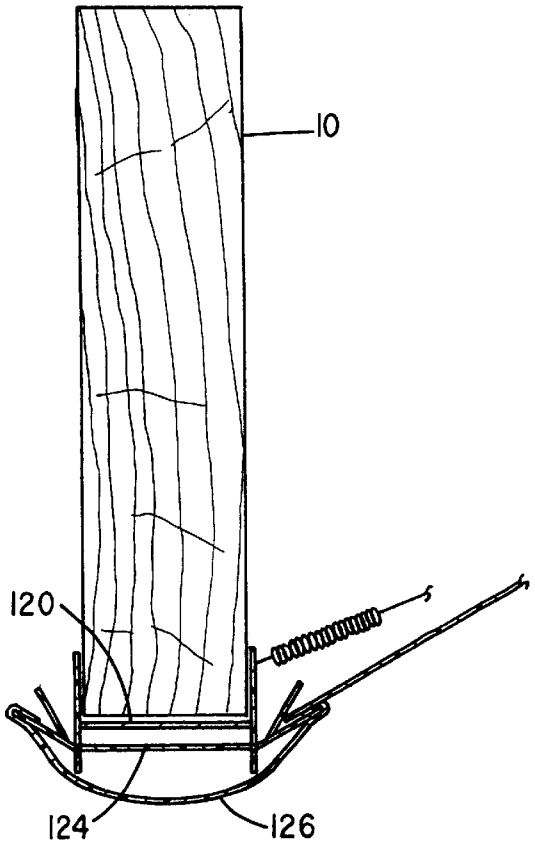
Figure 9A:
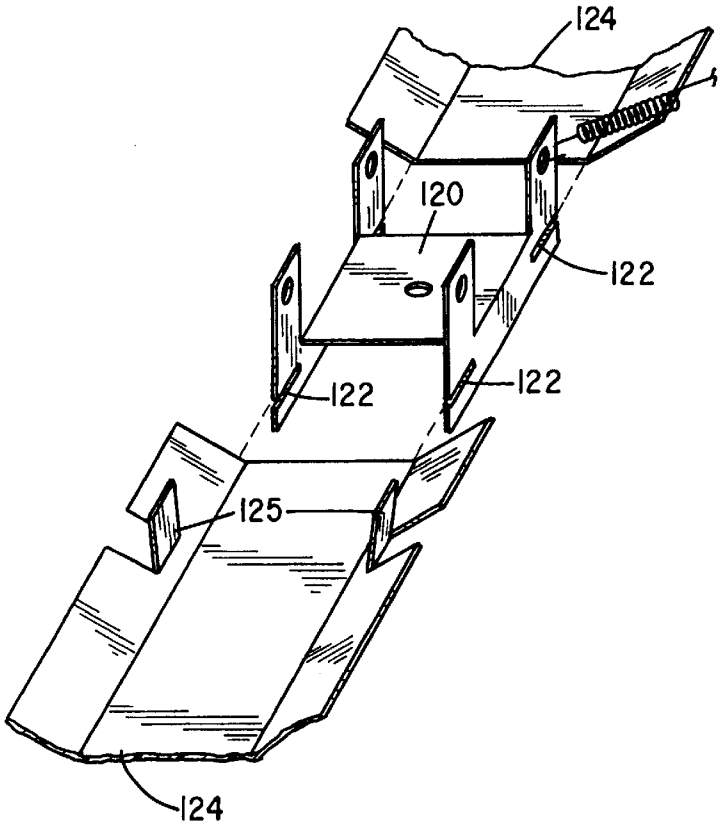
Figure 10A:
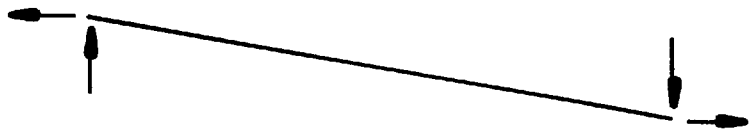
Figure 10B:
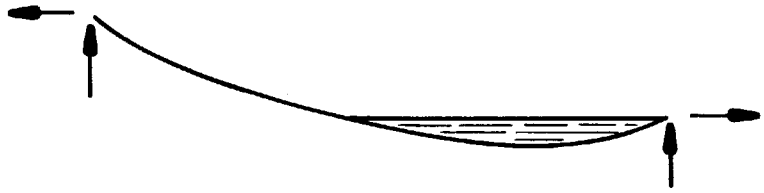
Figure 10C:
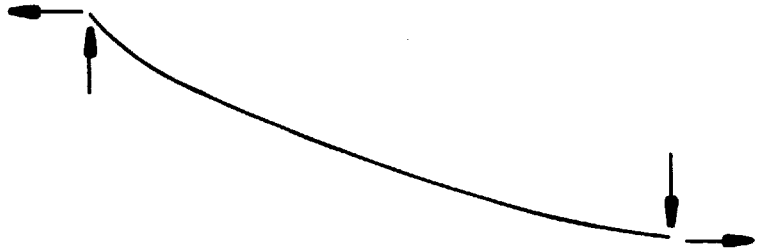
Figure 10D:
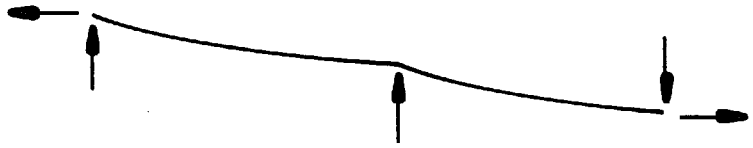
Figure 11A:
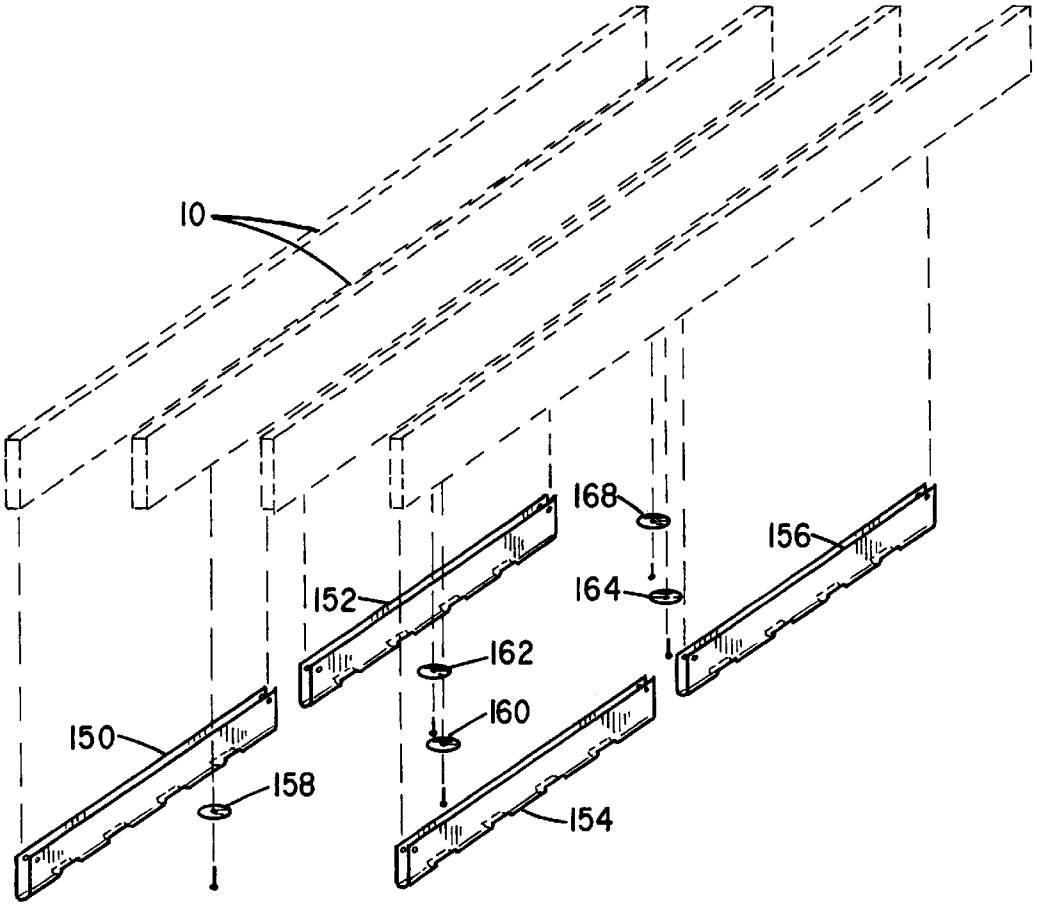
Figure 11B:
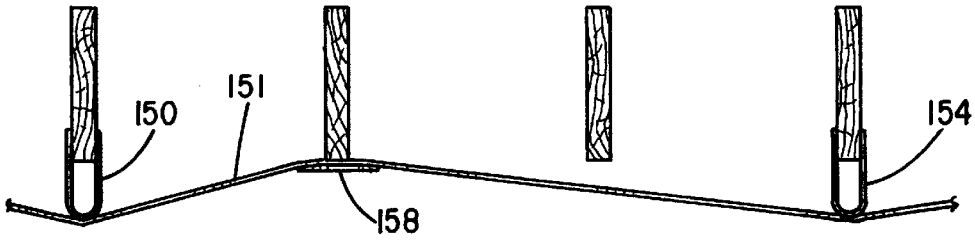
Figure 11C:
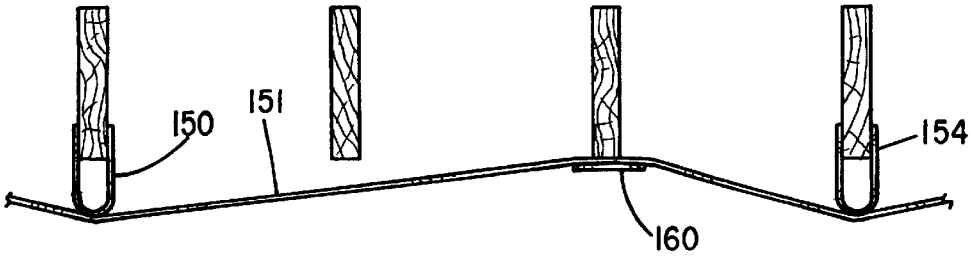
Figure 11D:
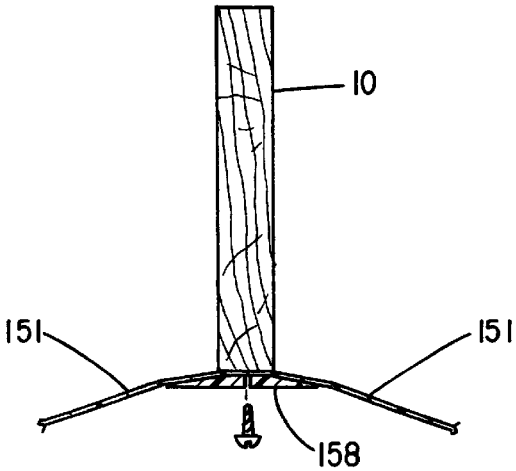
Figure 12A:
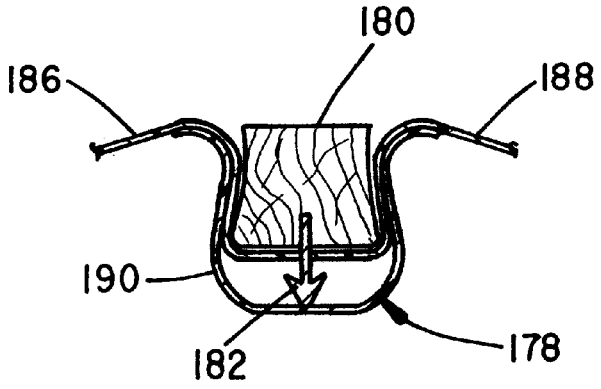
Figure 12B:
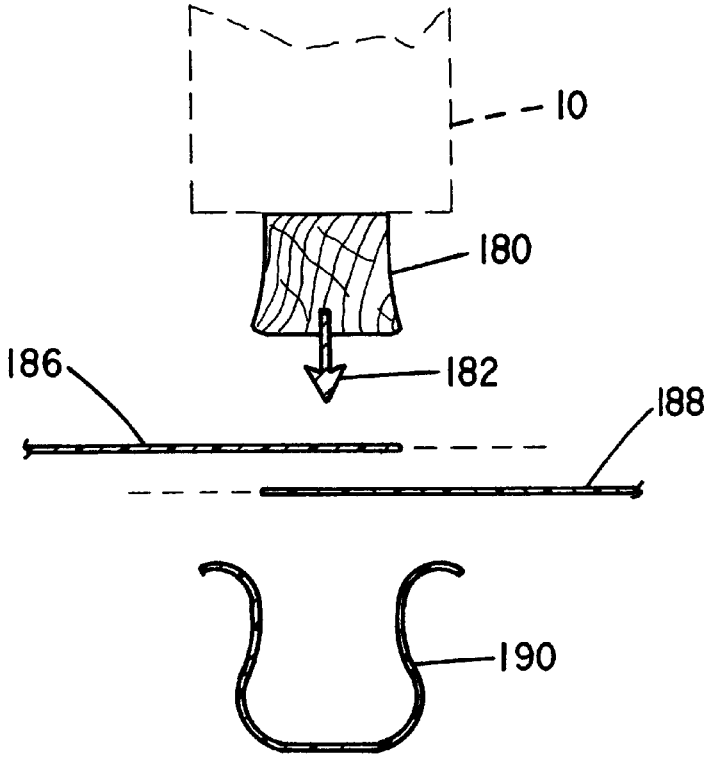
Figure 12C:
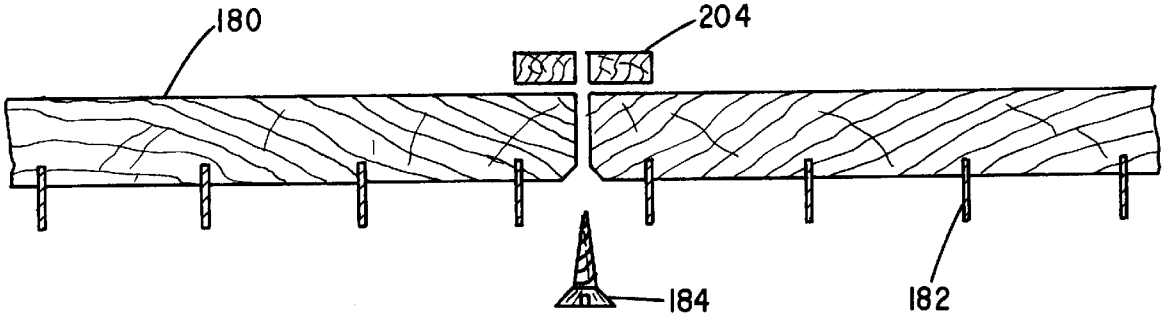
Figure 12D:
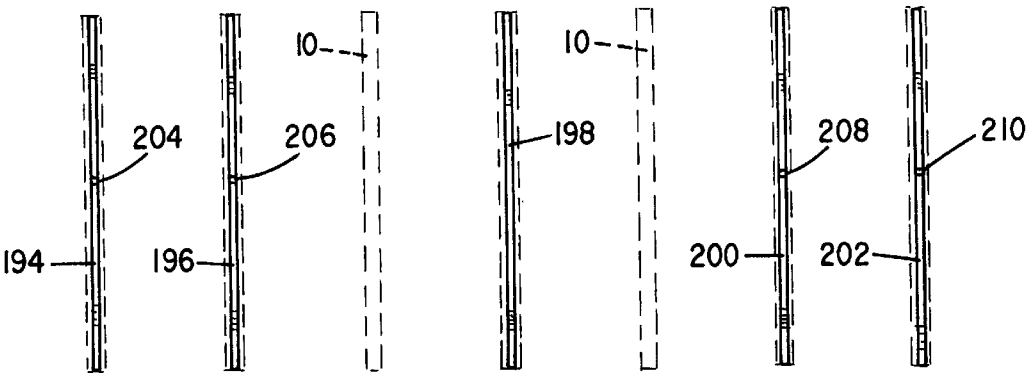
Figure 12E:
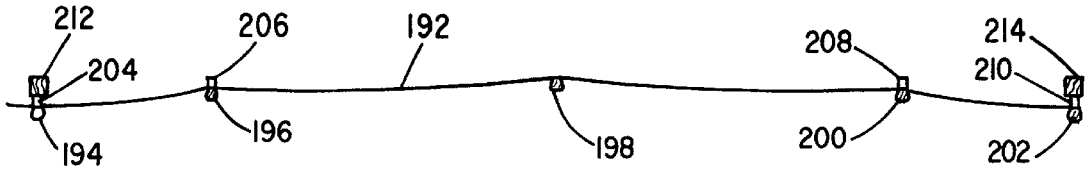
Figure 13A:
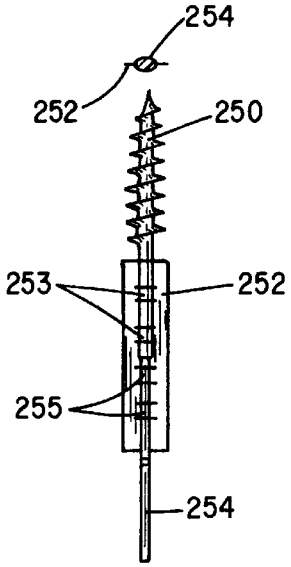
Figure 13B:
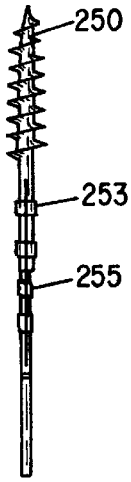
Figure 13C:
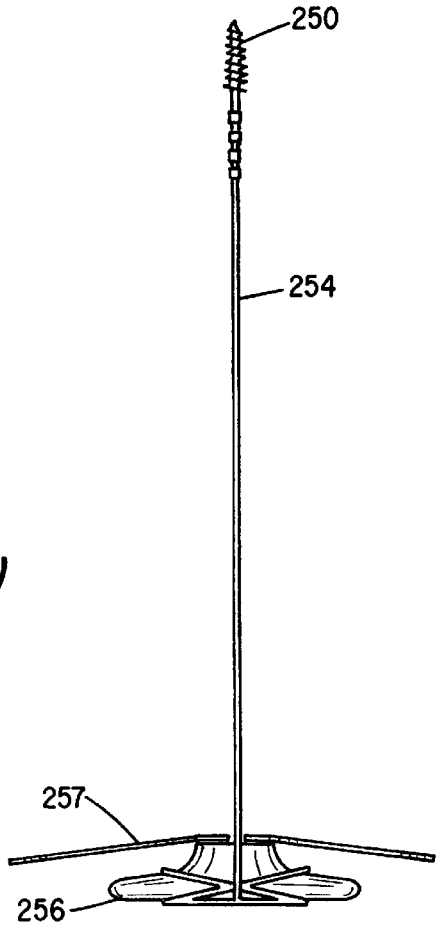
Figure 13D:
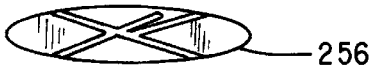
Figure 13E:
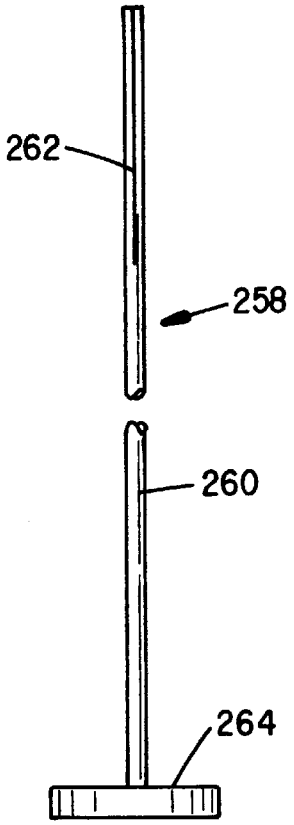
Figure 14A:
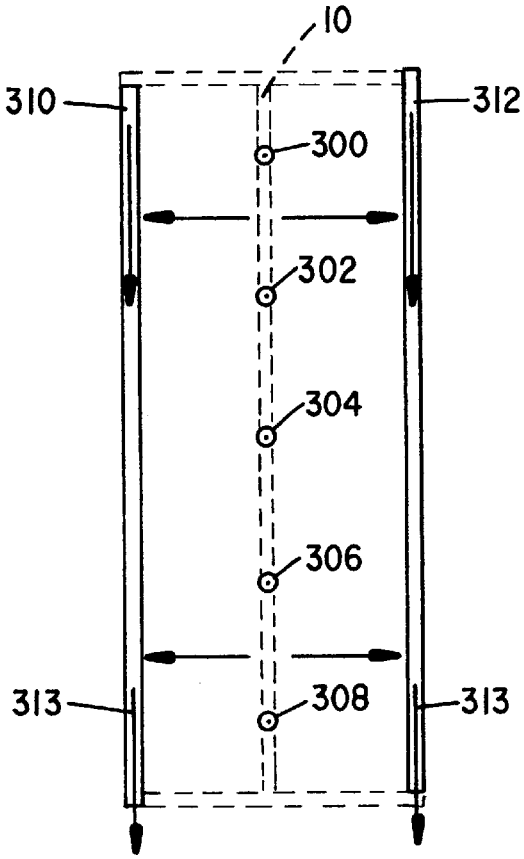
Figure 14C:
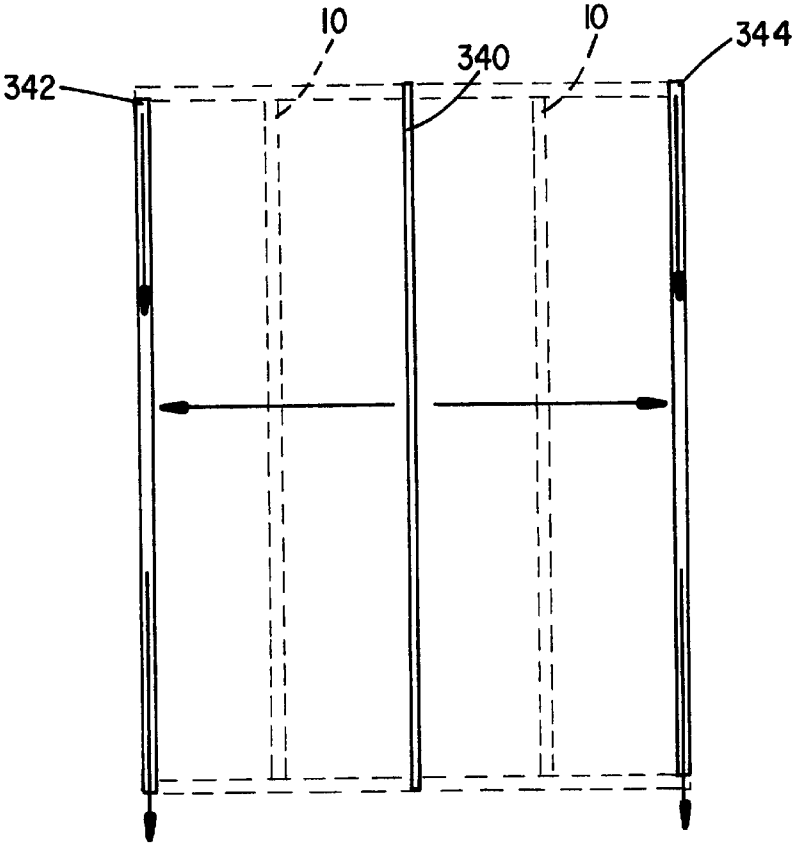
Figure 14B:
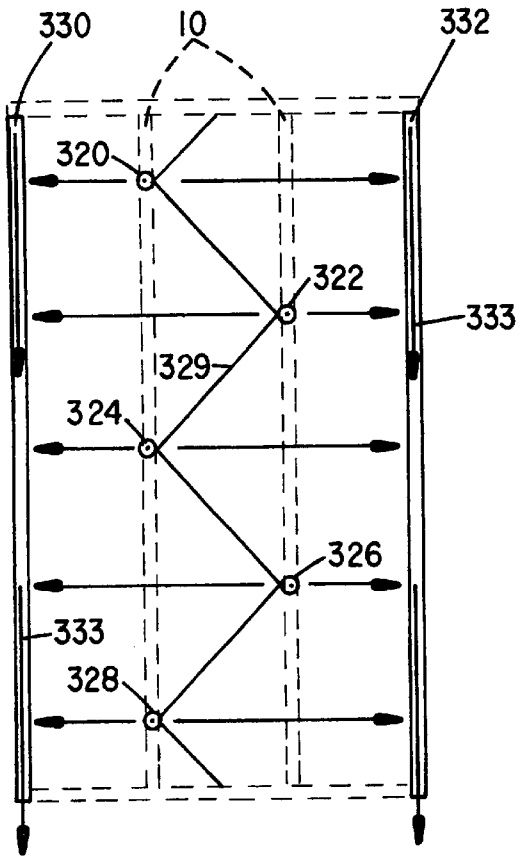
Figure 14D:
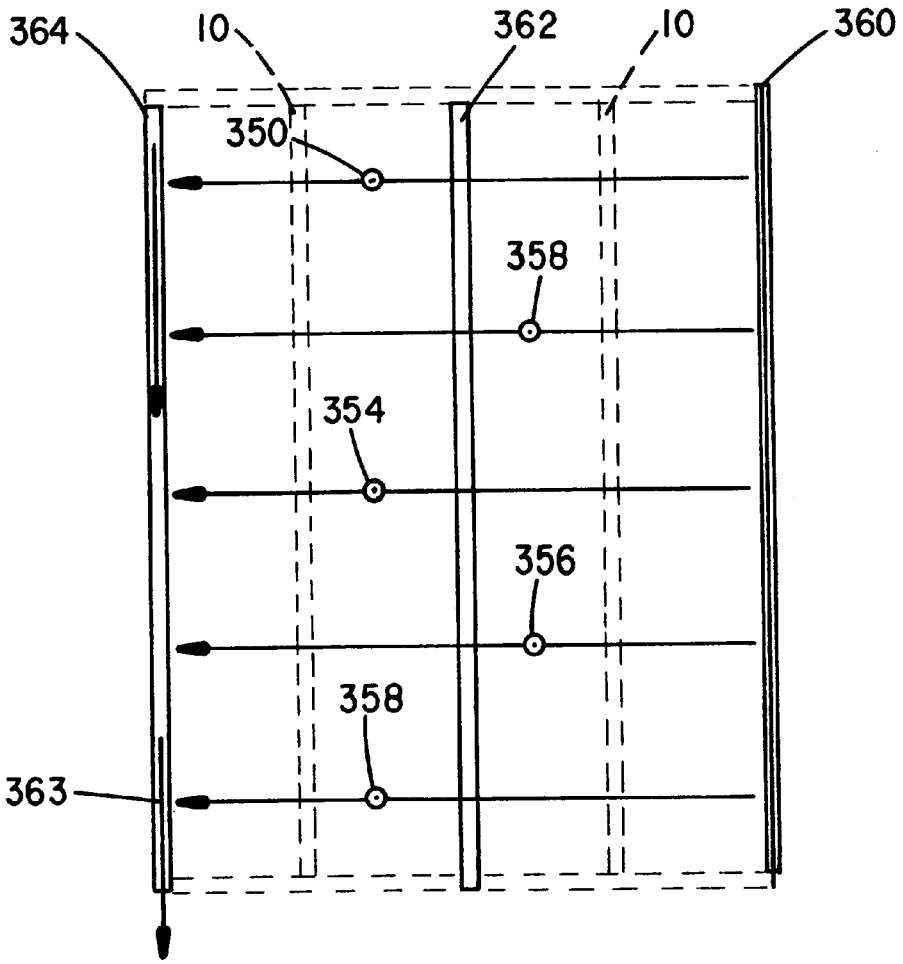
Figure 15A:
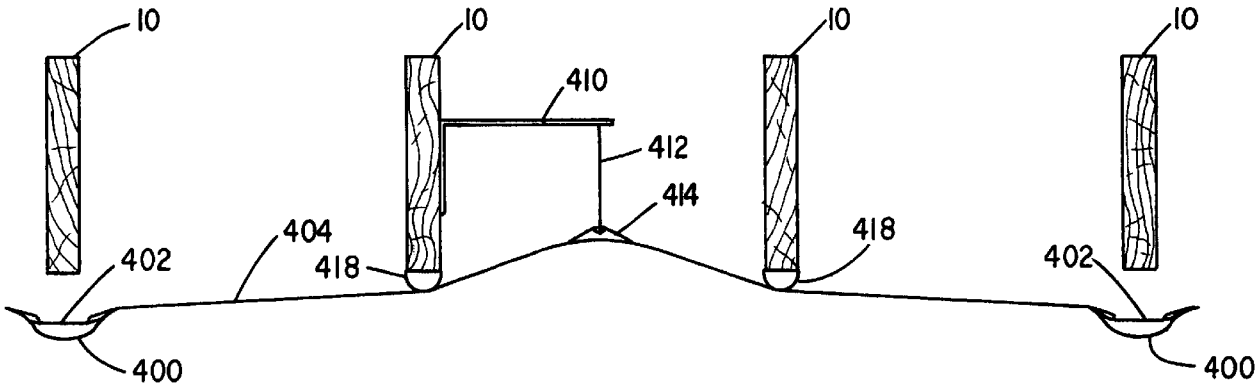
Figure 15C:
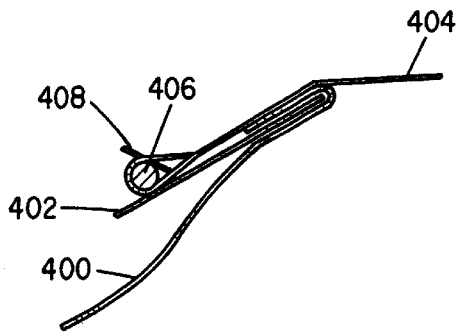
Figure 15B:
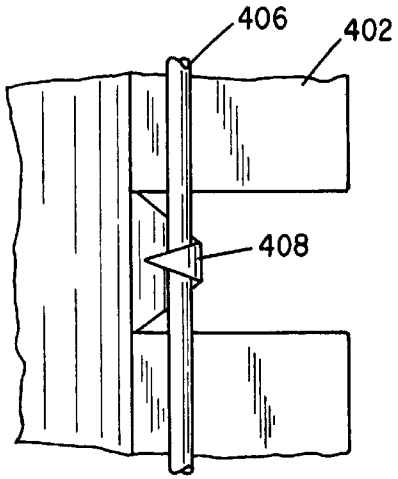
Figure 15E:
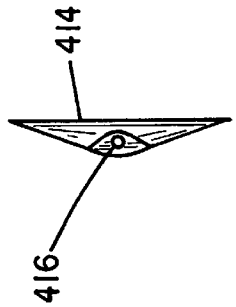
Figure 15D:
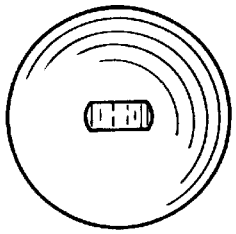
Figure 15F:
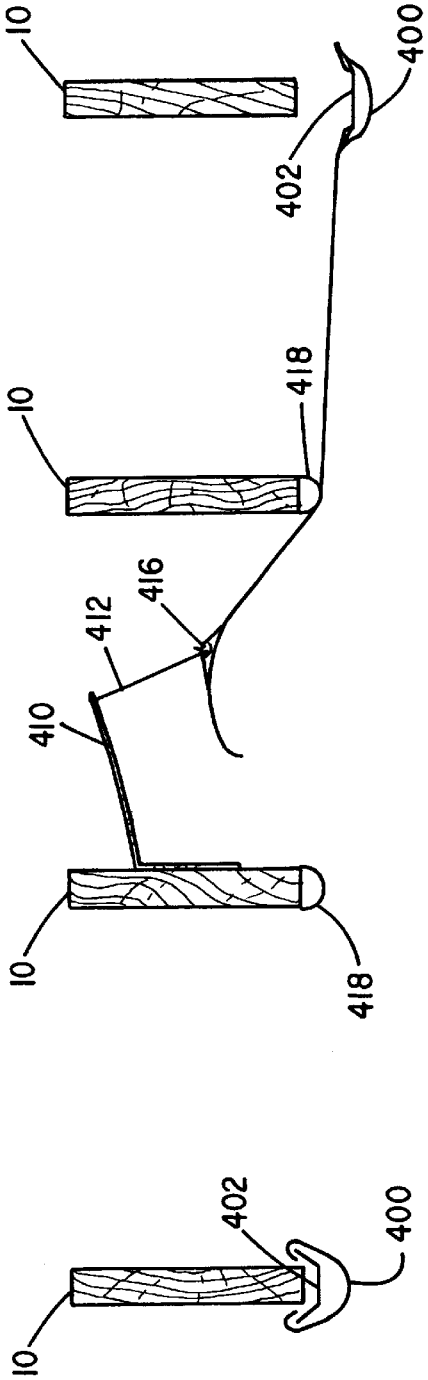
Figure 16A:
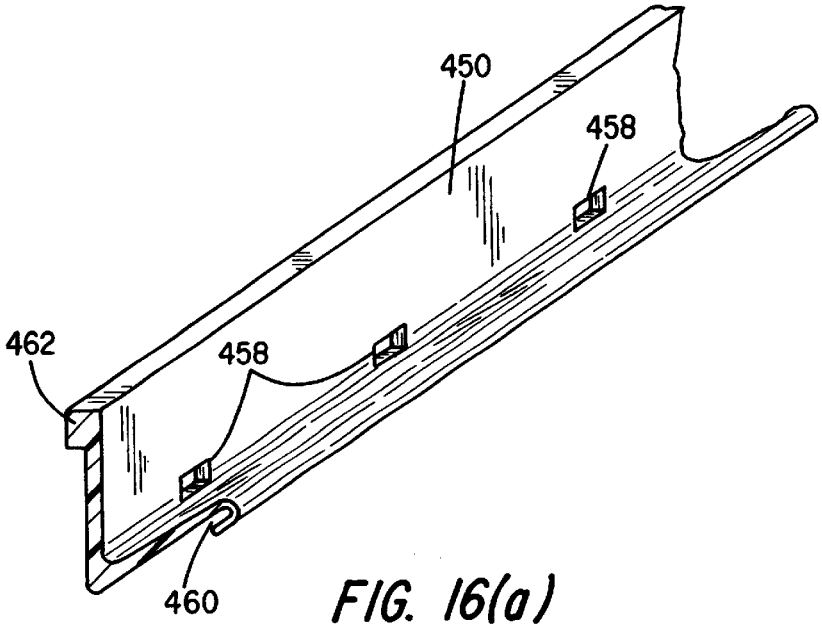
Figure 16B:
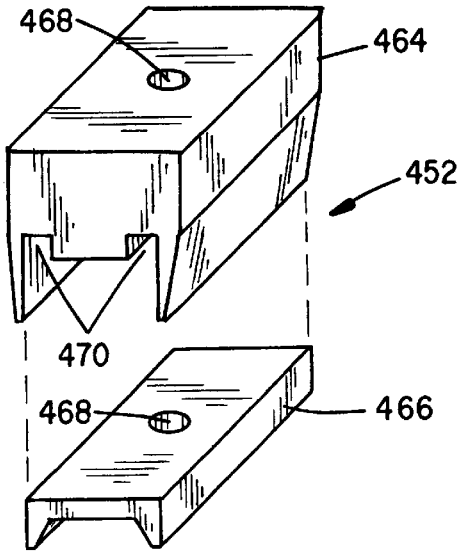
Figure 16C:
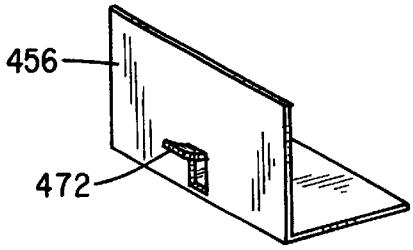
Figure 16D:
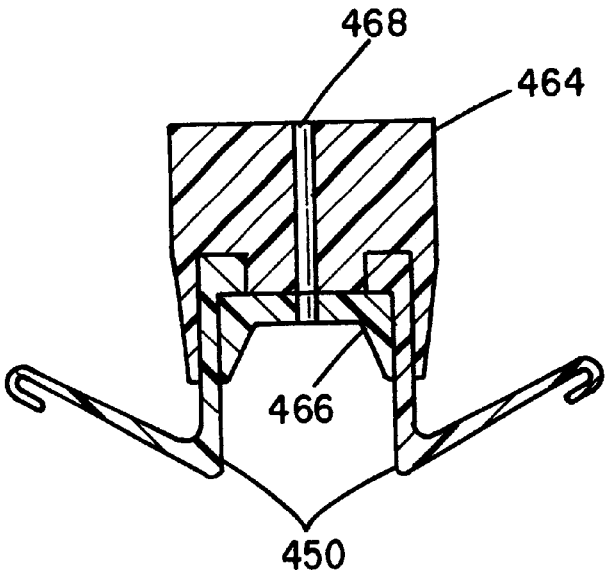
Figure 16E:
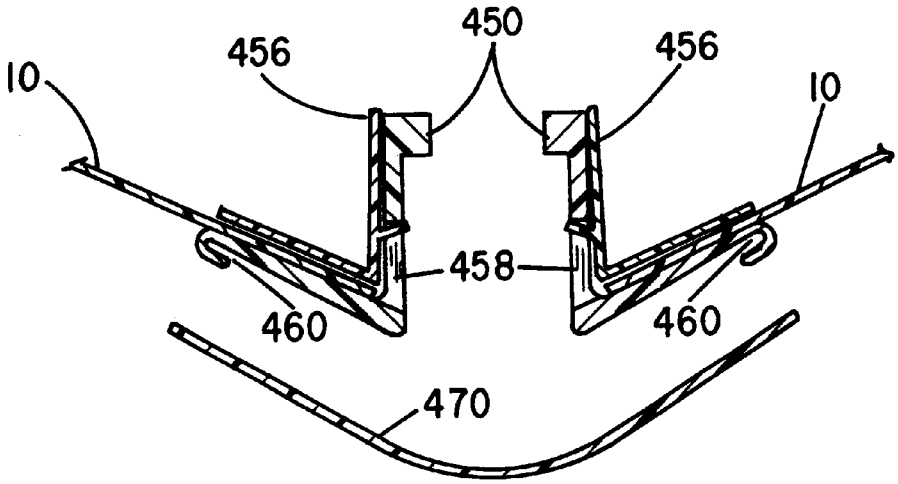
Figure 17A:
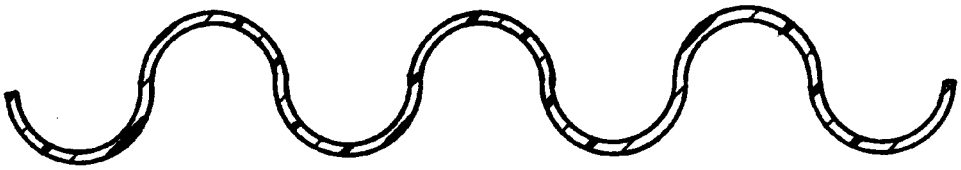
Figure 17B:
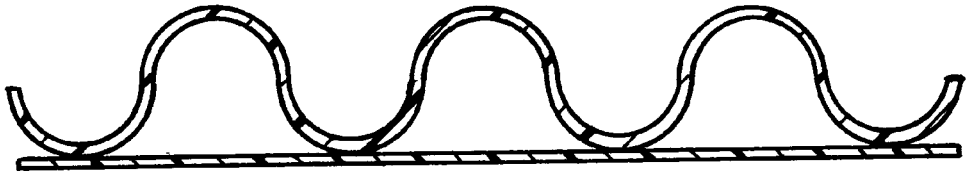
Figure 17C:
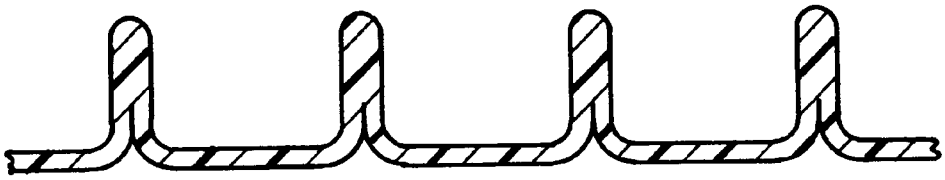

FIGS. 6(*a*) through 6(*d*) show the components of an alternative embodiment of the invention;

FIGS. 7(*a*) and 7(*b*) show an alternative gutter component and mode of attachment to a deck joist;

FIGS. 8(*a*) through 8(*d*) illustrate yet another embodiment for attaching collectors and gutters to the underside of a deck or walkway;

FIG. 9(*a*) illustrates a continuous gutter support member in an exploded view;

FIG. 9(*b*) is an end view of the gutter engaging the support member;

FIGS. 10(*a*) through 10(*d*) graphically illustrate the necessity of maintaining control over the collector contour to prevent puddling;

FIGS. 11(*a*) through 11(*d*) illustrate components for mounting a continuous collector sheet designed to span a plurality of joists so that water will drain from the surface of the collector without puddling;

FIGS. 12(*a*) through 12(*e*) show a tensioning apparatus for controlling the profile or contour of the collector sheets;

FIGS. 13(*a*) through 13(*e*) illustrates an arrangement for imparting a desired contour to pliable collector sheets;

FIG. 14 schematically illustrates the manner in which the system of the present invention can be applied in different size modules;

FIGS. 15(*a*) through 15(*f*) illustrate a combined configuration of mounting and shaping devices for affixing a compliant sheet collector to the undersurface of a deck or elevated walkway;

FIGS. 16(*a*) through 16(*e*) illustrates another alternative configuration for securing collectors and gutters to the underside of an elevated deck structure; and FIGS. 17(*a*) through 17(*c*) illustrate other shape profiles for coilable collector panels useable with the present invention.

DETAILED DESCRIPTION OF THE PREFERRED EMBODIMENT

Figure 1:
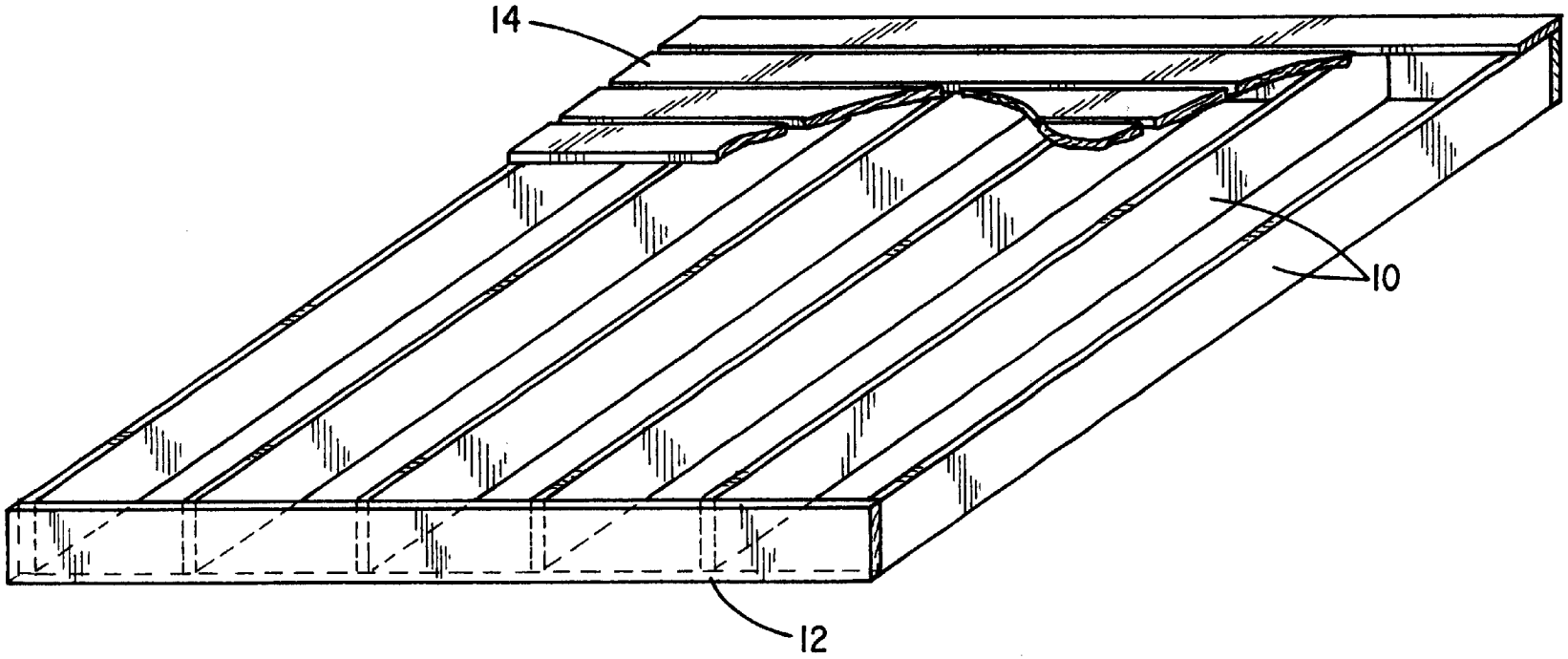
FIG. 1 (PRIOR ART)
FIG. 1 is a perspective view, partially sectioned, to show the general construction of a typical residential deck.
Figure 2A:
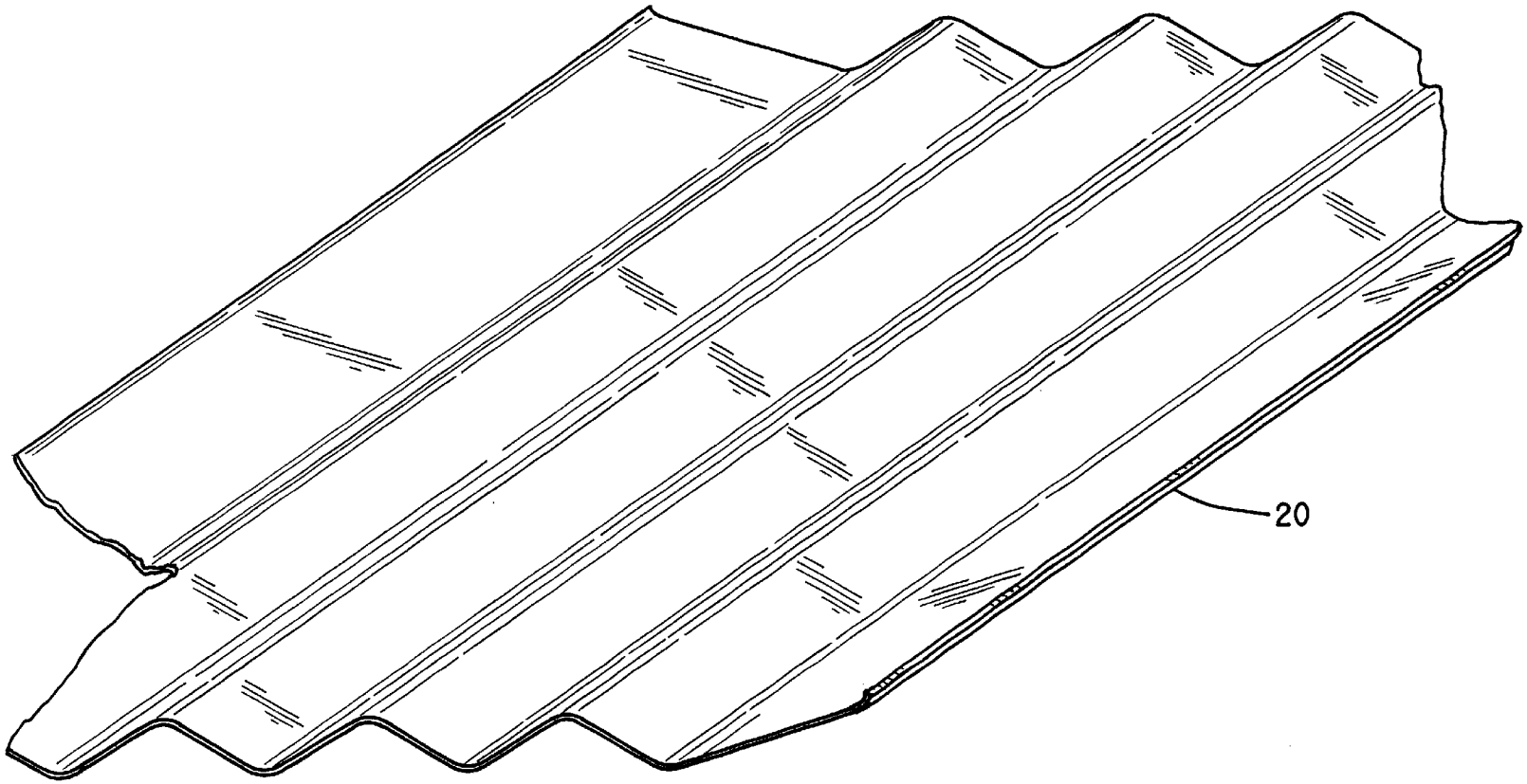
FIGS. 2(*a*), 2(*b*) and 2(*c*), respectively, show a perspective view of a collector component of one embodiment of the invention, an end edge view of the collector of FIG. 2(*a*) and the gutter component thereof.
Figure 2B:
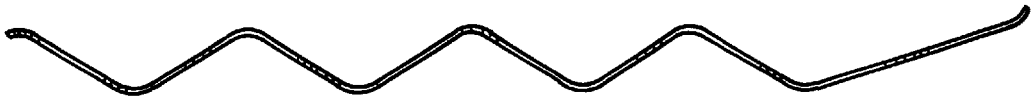
Figure 2C:
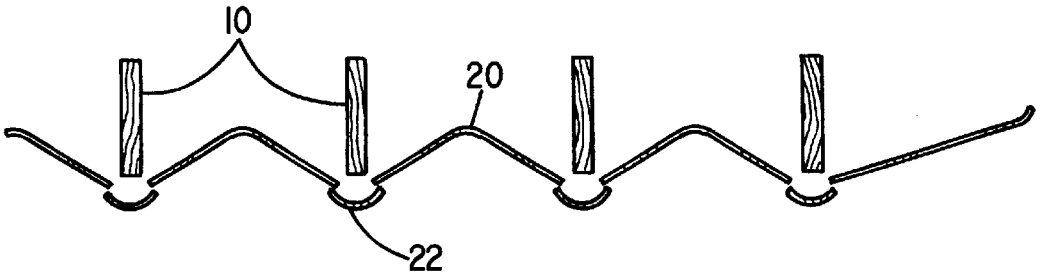
Figure 3A:
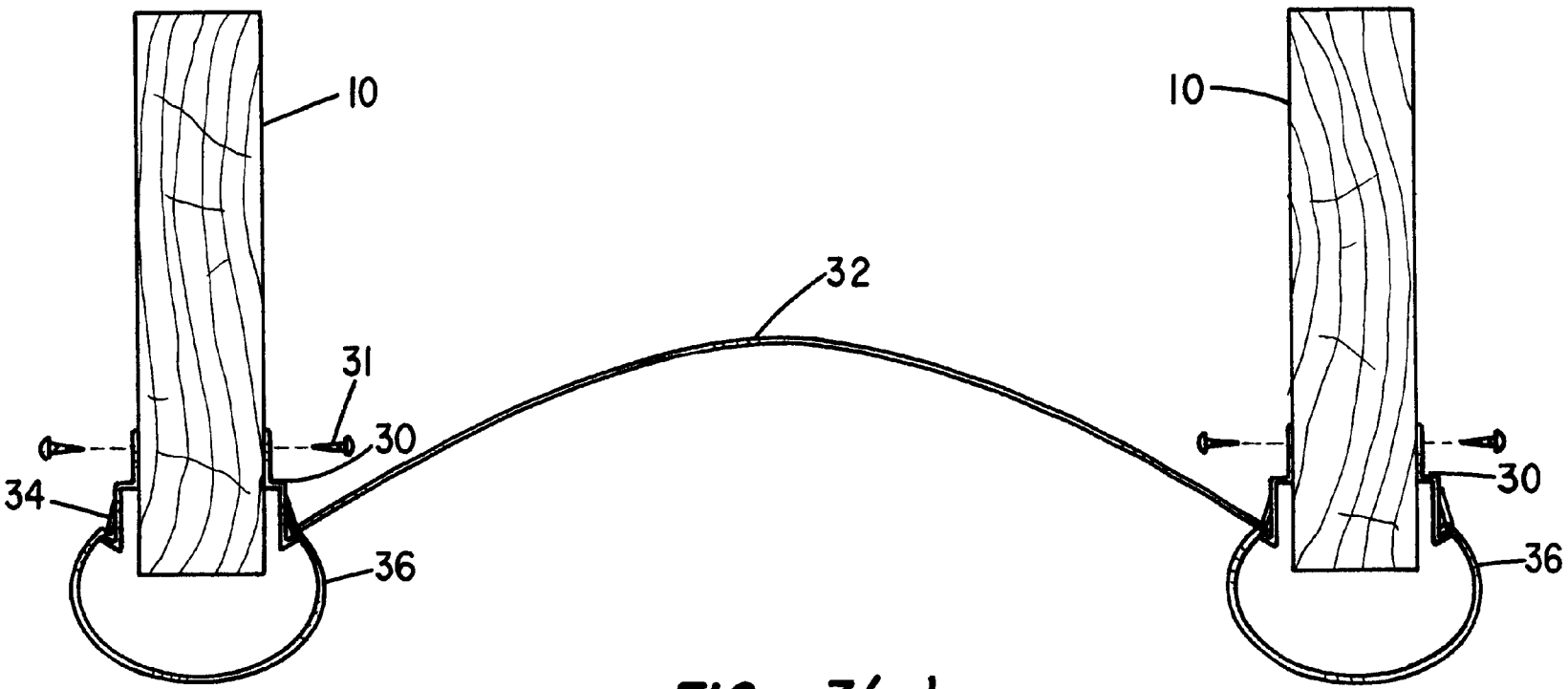
FIG. 3(*a*) is an end view of a pair of adjacent deck joists with a collector and gutters suspended therefrom.
Figure 3B:
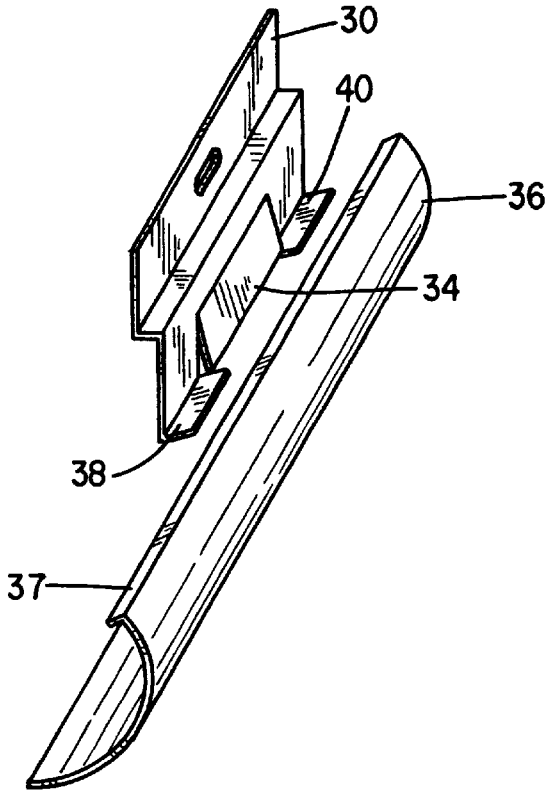
Figure 3C:
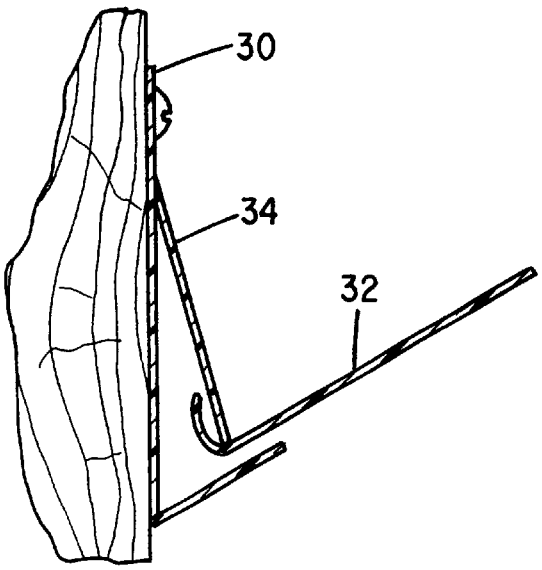
Figure 3F:
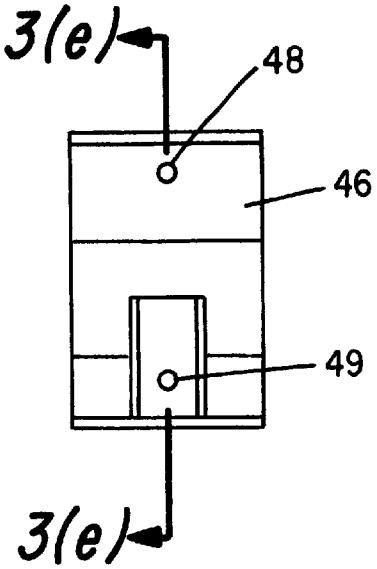
Figure 3E:
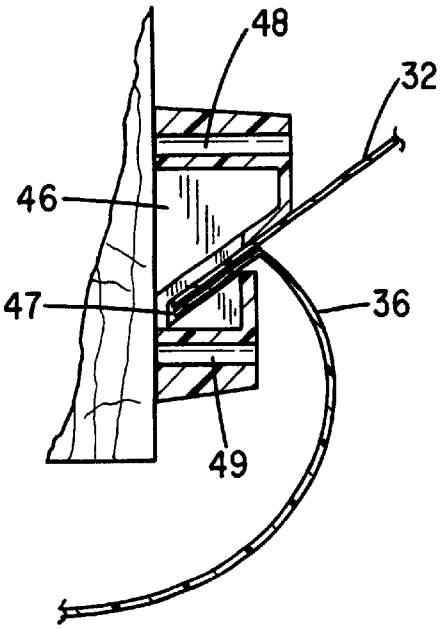
Figure 3D:
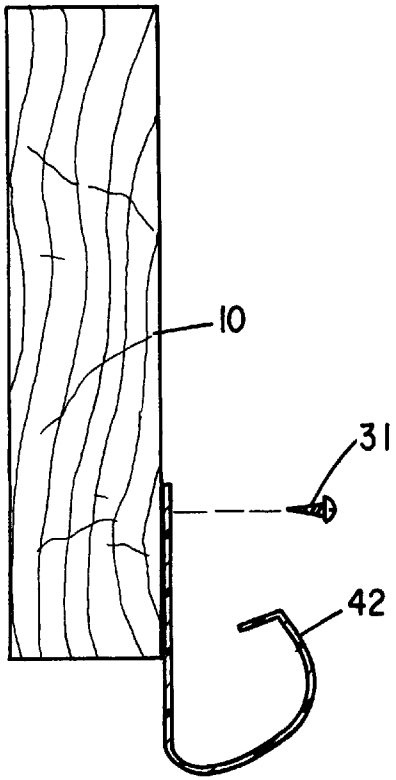
Figure 3H:
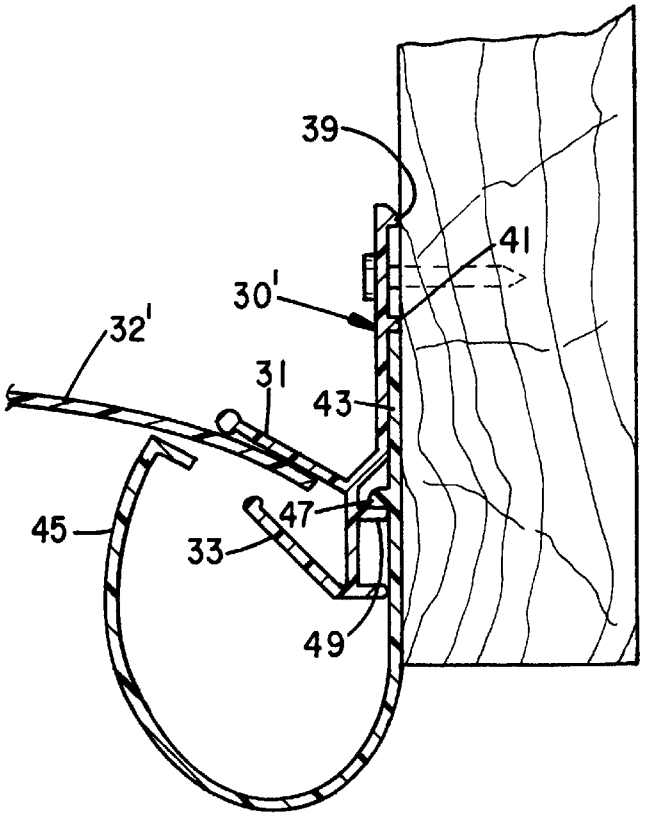
Figure 3G:
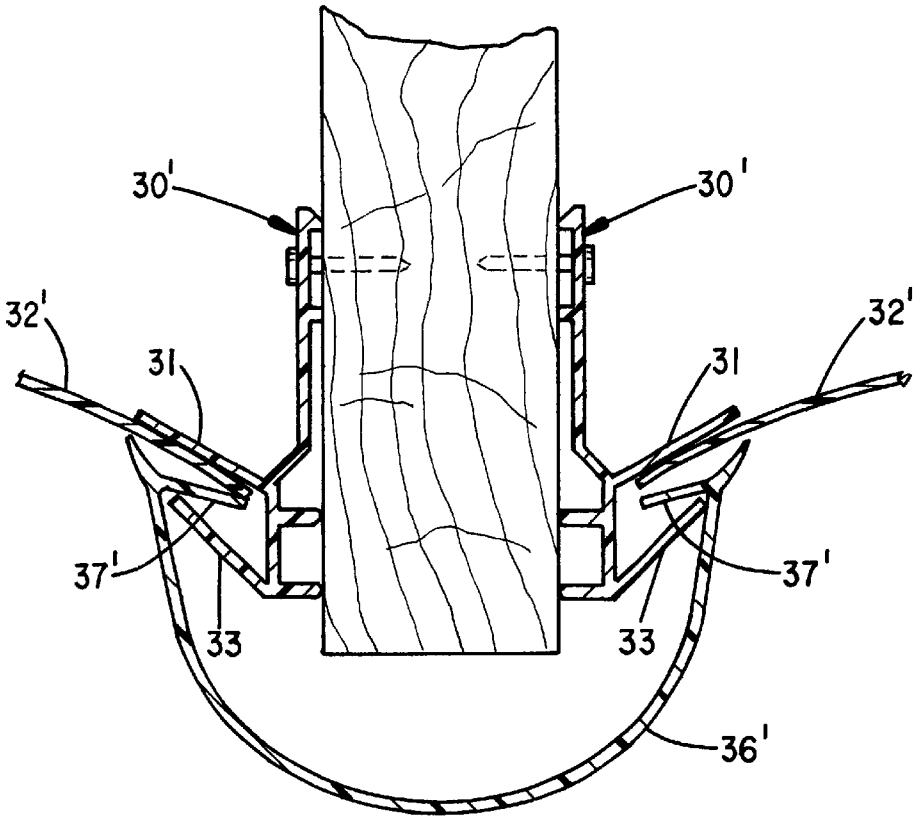

With reference to FIGS. 2(*a*) through 2(*c*), the rain water collection apparatus of the present invention comprises a plurality of collector sheets 20 that are formed so as to be convex on their upper surface and concave on their lower surface when installed between joists 10 of an elevated deck structure. The collectors may be thin aluminum sheets or preferably roll-formed, generally rectangular plastic sheets of a sufficient thickness and resiliency so that when bowed, they will provide a counteracting force tending to return the sheet material to a planar condition. To provide longitudinal rigidity, the individual sheets spanning adjacent joists can be corrugated as indicated in FIGS. 2(*a*) and 2(*b*), but in most instances, this is unnecessary unless, of course, the sheet material of the collector 20 is quite thin.

FIG. 3(*a*) shows a collector and gutter system wherein collector 32 is compressively retained by mounting brackets 30 in a position which allows water to drain between the side edge of collector 32 and joist 10. Gutter 36 is also retained by mounting brackets 30. It is formed of a resilient material with a radius somewhat smaller than the installed radius such that, when being installed, it must be spread so that when released, there is a compressive force acting to maintain contact with the bracket.

Mounting brackets 30 are mounted to facing vertical sides of adjacent joists 10. Additional brackets, not shown, are mounted along the joists at an interval sufficient to provide adequate support. There is a trade off which must be made here. The number of attachment points should be minimized for ease of installation, however a larger interval between mounting brackets requires a stiffer, and thus more expensive, collector and gutter design. FIGS. 3(*b*) and 3(*c*) show one type of mounting bracket 30 in more detail. Shown here is tab 34 which functions to partially retain collector 32. If the collector is fabricated of crimpable material, such as aluminum or galvanized steel, additional retention may be accomplished by crimping the edge of collector upward so as to be locatable behind tab 34 as shown in FIG. 3(*c*). Collector 32 is installed by transverse compression to snap into mounting brackets 30. Alternatively, mounting bracket 30 could be modified to accommodate any well known fastening means to retain the collector by piercing it. For example, apertures in the mounting bracket would allow a nail to pierce the collector and attach to the joist. Collector 32 may be any sheet material which will maintain a crowned shape under side-edge compression.

As shown in FIG. 3(*b*) gutter 36 is formed with side lips or flanges 37. The gutter is suspended from mounting brackets 30 by engaging flange 37 with tabs 38 and 40. Gutters 36 may be formed of any material and process which results in a semi-rigid structure. As used herein the term semi-rigid refers to a structure which would not sag or otherwise deform as installed. The embodiment of FIGS. 3(*a*)–3(*c*) requires a semi-rigid structure, such as extruded PVC, to span the distance between mounting clips without sagging.

FIG. 3(*d*) is an end view of a gutter design suitable for the interior side edges of the decks. As shown, gutter 42 is attached to the inside face of an outermost joist with screw 31. The gutter can be reversed end-for-end, when attaching it to the inside face of the opposite outermost joist. An elongated slot in gutter 42 provides for thermal expansion and contraction.

FIGS. 3(*e*) and 3(*f*), respectively, show a front view and a cross-sectional view of an alternative embodiment of a mounting bracket 46 for connecting a gutter component to a joist which may be formed by injection molding of a plastic. Mounting bracket 46 is fastened to the side of joist 10 by nails, not shown, which pass through nail holes 48 and 49. Slot 47 in bracket 46 receives an edge of collector 32 therein as well as an inwardly turned flange of gutter 36, each being retained by the aforementioned compressive forces.

FIG. 3(*g*) illustrates by means of an end view a mounting bracket 30' that differs slightly from that shown in FIG. 3(*a*). The mounting bracket 30' comprises an extruded strip approximately 20 in. in length and which is adapted to affixed to opposed side surfaces of the joist 10 by means of nails or screws. The extrusion includes upper and lower tines 31 and 33, respectively, which project obliquely at differing angles from the joist 10 to define an elongated slot therebetween. The slot is dimensioned to receive an edge of a collector panel 32' along with the flange 37' of the gutter 36'. In that the collector panels are under compression by virtue of the fact that their widths are greater than the spacing between joists and, hence, are bowed upwardly, they stay retained in the slot of the mounting bracket 30'. Likewise, because the side edges of the gutter must be spread apart from one another in order to have the flanges 37' fitted into the elongated slots of the two mounting brackets, the spring force tending to return the gutter to its unstressed state insures that they will not pull free of the mounting brackets without manual intervention.

FIG. 3(*h*) illustrates the mounting bracket 30' affixed to a rim joist of a deck structure, the rim joist being the outermost joist of the deck. The bracket 30' is nailed or screwed to an inner side surface of the rim joist and, as can be seen, the inwardly extending nubs 39 and 41 act as stand-offs or spacers allowing the thickness dimension of the uncurved portion 43 of a specially shaped gutter member 45 to be sandwiched between the bracket 30' and the rim joist. A protuberance 47 on the gutter 45 cooperates with a finger-like projection 49 on the bracket 30' to snap or latch the gutter in place when the straight portion 43 thereof is forced upward into the space or pocket created by the stand-offs 39 and 41. Again, the slot defined by the outwardly and obliquely projecting tines 31 and 33 receives the edge portion of a collector sheet 32'

When it is desired to discharge water from only one end of the gutter, discharge from the other end must be blocked by an end cap or end plug, not shown. The end plug is preferably a resilient material, totally contained within gutter 36, which forms a water-tight seal by exerting an expanding force upon the inner surface of the gutter. The end cap may be a plastic structure which pinches the end of gutter 36 to form a water-tight seal.

Figure 4:
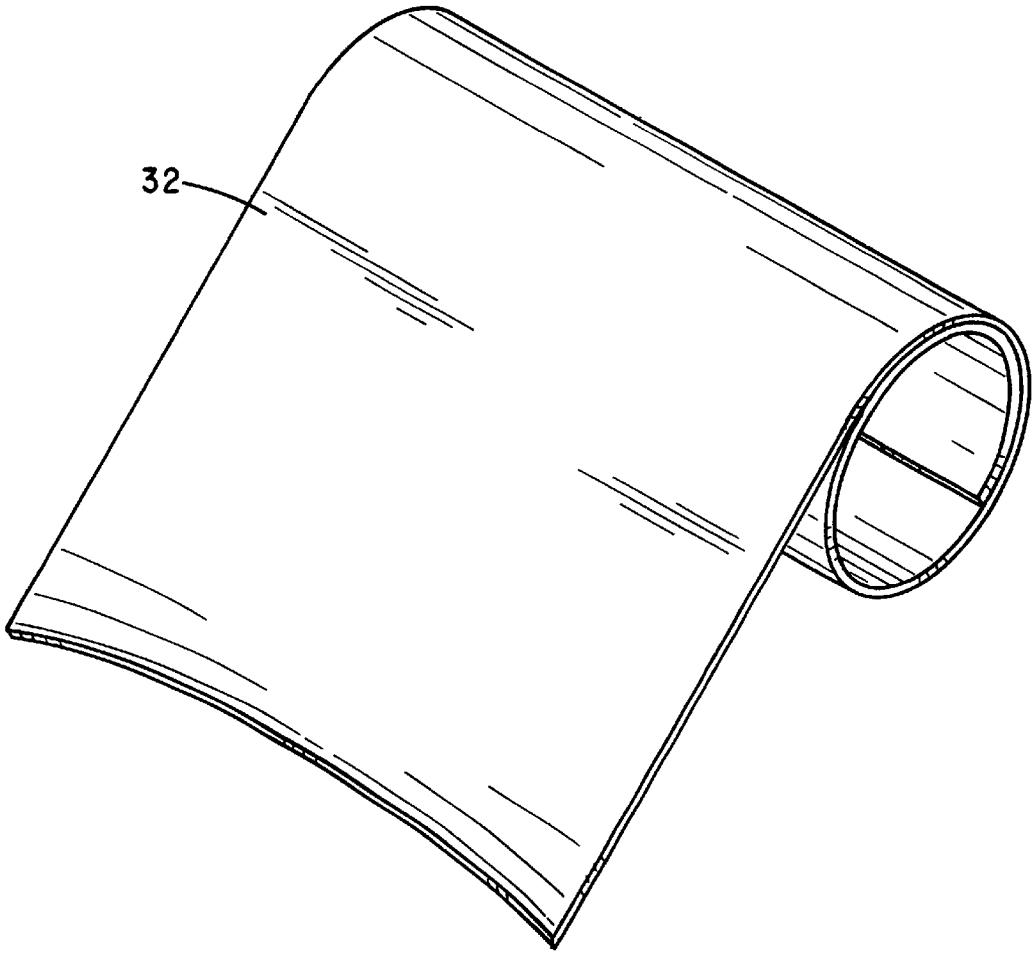
FIG. 4 is a perspective view of the collector component in coiled form prior to installation beneath a deck structure.
Figure 5A:
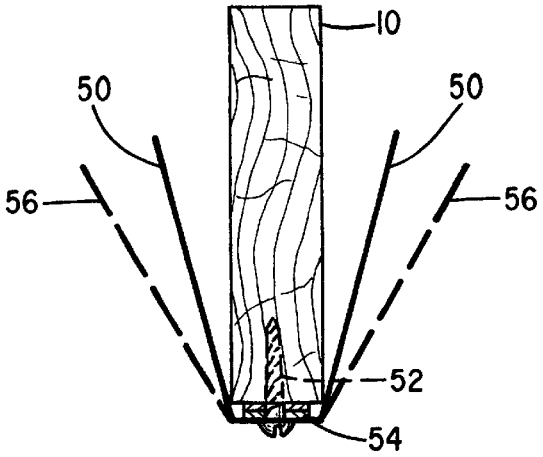
FIGS. 5(*a*) through 5(*h*) illustrate the components of an alternative embodiment of the invention.
Figure 5B:
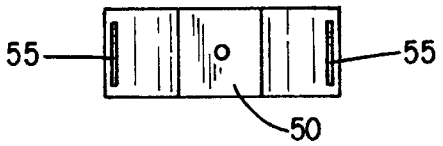
Figure 5C:
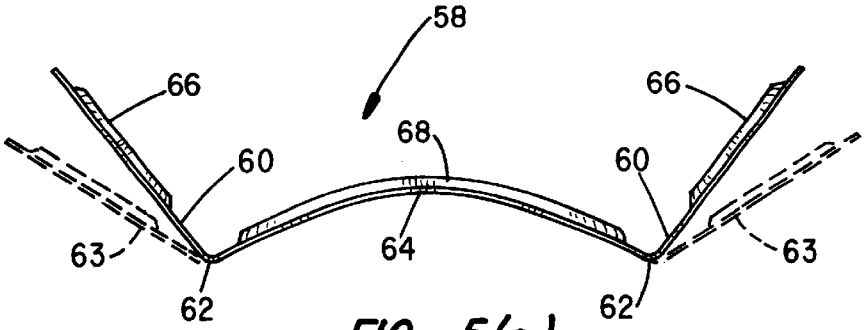
Figure 5D:
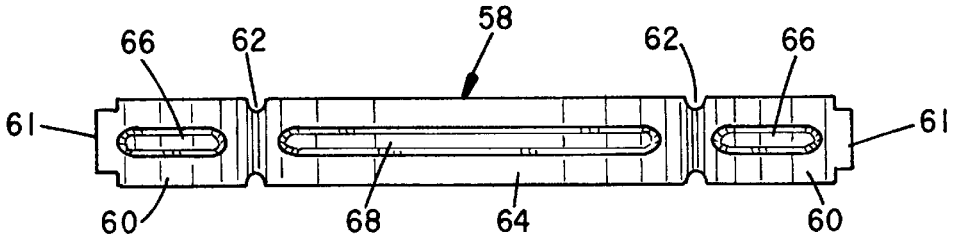
Figure 5F:
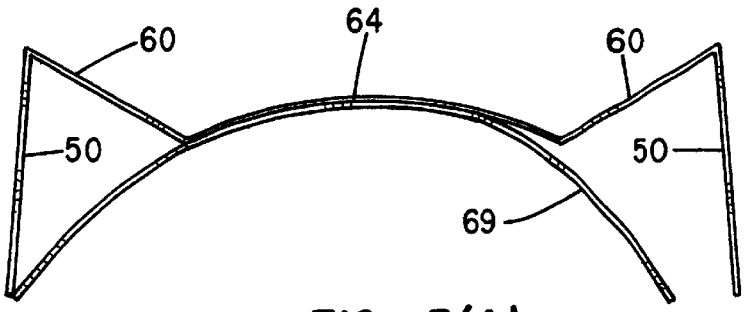
Figure 5E:
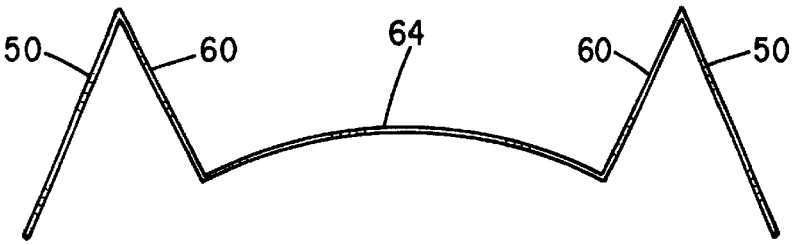
Figure 5H:
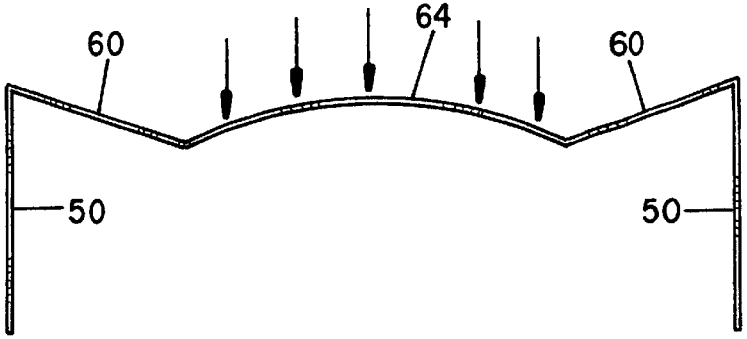
Figure 5G:
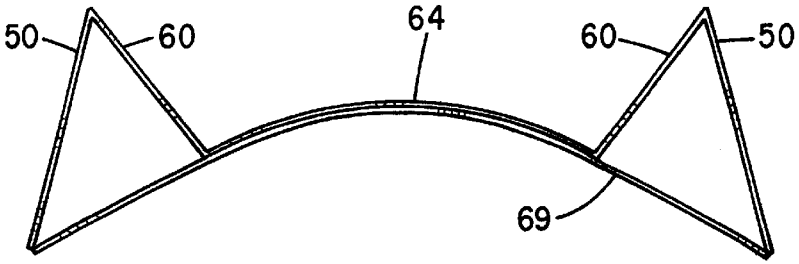
Figure 6A:
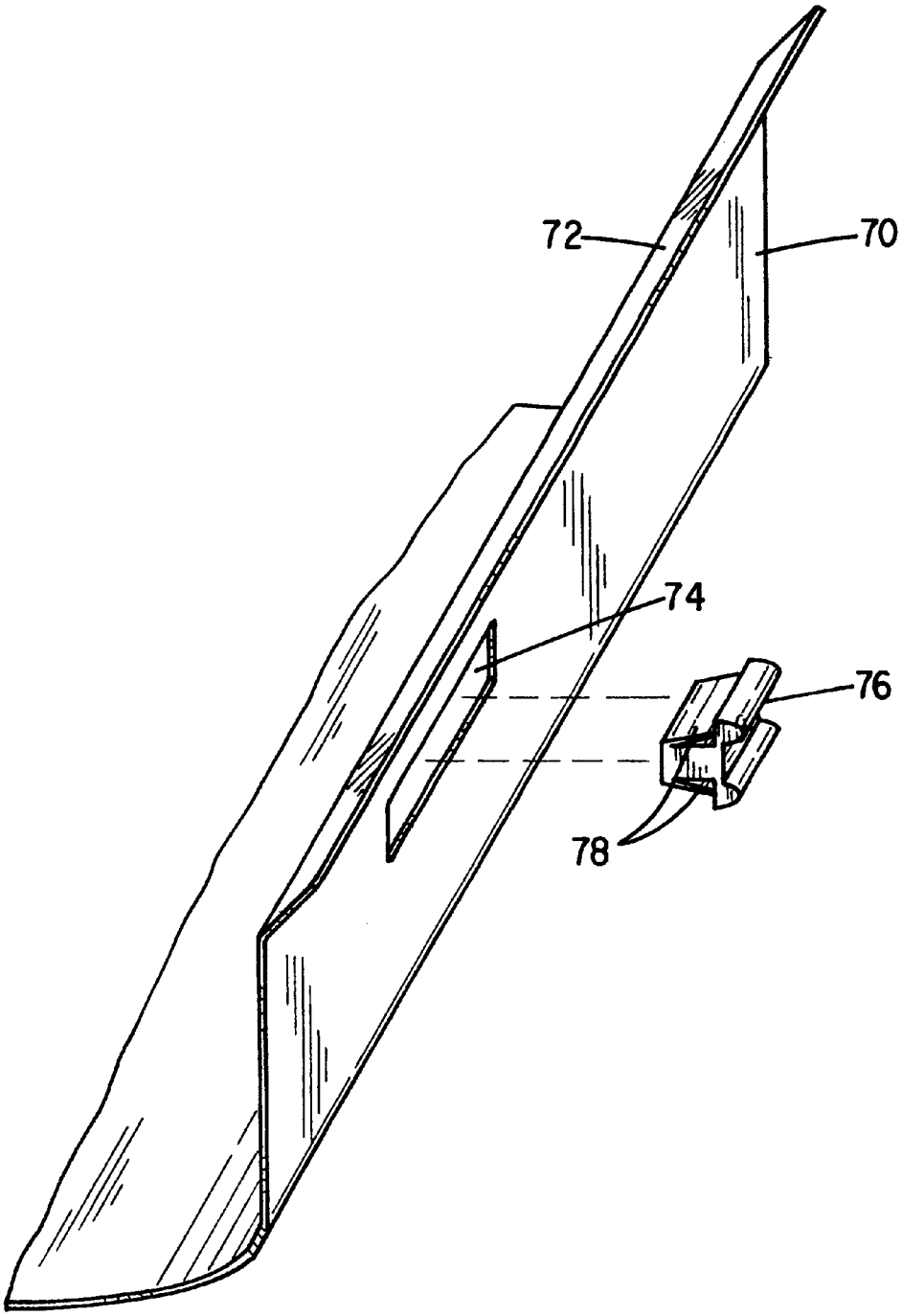
Figure 6C:
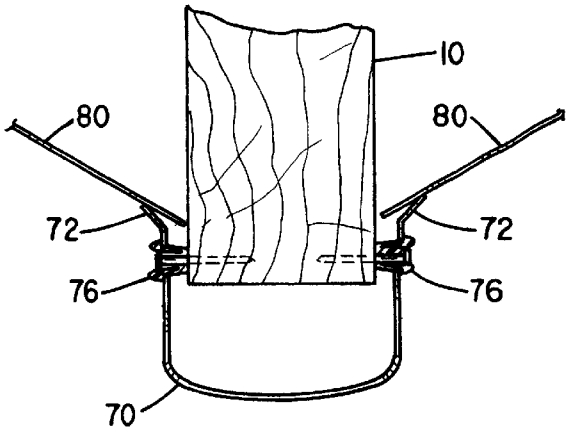
Figure 6D:
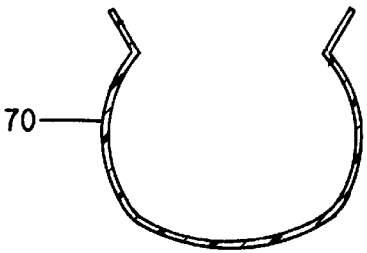
Figure 6B:
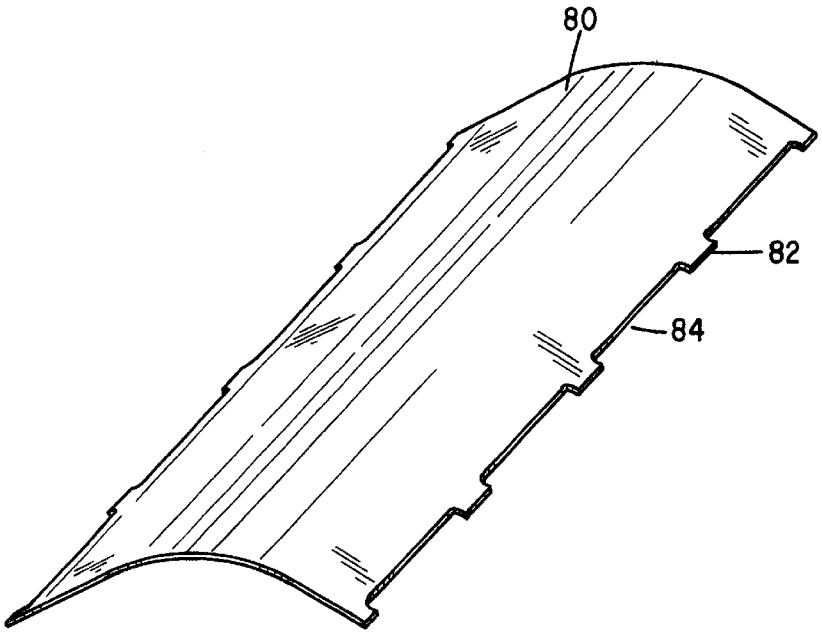

For many deck structures, the collector could be very unwieldily to install as a single section due to its length. To facilitate handling, the collector may be fabricated with both a longitudinal and transverse stress such that it has two stable rest modes. The first rest mode is achieved by rolling the collector in the transverse direction wherein the crown is formed. The second rest mode is achieved by additionally rolling the collector in the longitudinal direction to make it coil. As shown in FIG. 4, the collector maintains a flat mode when coiled, but converts to the semi-rigid crowned or convex mode as it is uncoiled. It is thus possible for a single person to readily handle and install a single piece collector of virtually any length by simply unrolling same as it is being inserted into its joist mounted support brackets. Alternatively, a long collector may subdivided into a plurality of shorter sections to facilitate handling. There are a variety of well-known ways to accomplish a water-tight seal at the end joints of such sections. For example, VHB type 4622 acrylic foam tape, manufactured by Minnesota Mining and Manufacturing (3M), may be applied to the underside of the collectors after they have been installed. Alternatively, collector ends may be joined with a resilient gasket in either an end-to-end configuration or an overlapping configuration.

FIGS. 5(*a*) and 5(*h*) show an alternative means for retaining the collector. With reference to FIG. 5(*a*), an end view of a U-shaped mounting bracket 50 is shown attached to a bottom edge surface of joist 10 with screw 52. Spacers 54 may be optionally interposed to add slope or pitch to the system. FIG. 5(*b*) shows a bottom plan view of mounting bracket 50, including slots 55 which receive the compression member 58 of FIG. 5(*d*). The mounting bracket is comprised of relatively stiff resilient material which behaves as a spring to be the source of a compressive force to retain the collector acting through compression member 58. The heavy solid line indicates the position of the bracket under compression as installed, while dashed lines 56 indicate its position prior to installation of the collector sheets. FIGS. 5(*c*) and 5(*d*) show a side view and plan, respectively, of one of the compression members 58. Compression member 58 is comprised of relatively compliant material. Its wings 60 transmit the compressive force of mounting bracket 50 to region 64, via hinge points 62. Dotted lines 63 in FIG. 5(*c*) show the rest position of wings 60 when unflexed. Connection to mounting bracket 50 is accomplished by ears 61 on the ends of wings 60 which engage slots 55 in the mounting bracket. Compression member 58 operates most efficiently when flexure is confined to hinge points 62. Toward this end, elements 60 and 64 are stiffened by embossed ribs 66 and 68 while hinge point 62 is made more compliant by reducing the width of the compression member 58 in this region. The result is that only a small fraction of the force from mounting bracket 50 is required to overcome hinge points 62 and a persistent downward retaining force is transmitted to the domed portion of collector 69 (FIG. 5(*f*)).

FIGS. 5(*e*)–5(*h*) show the range of flexure of elements 50, 60, and 64. In FIG. 5(*e*) the compression member 58 has been wedged between the mounting clips 50 and is under a slight compression to hold it in place prior to installing the collector 69. In FIG. 5(*f*) these elements have flexed to allow the installation of collector 69, while in FIG. 5(*g*) the collector has been set in its installed position.

The system of FIGS. 5(*a*)–5(*h*) may be designed to provide a relatively low retaining force sufficient for nominal extremes of wind velocity since the collector is positively retained at the limit of flexure as shown in FIG. 5(*h*) where mounting bracket 50 has been compressed to an almost vertical position, such that it is now in contact with a joist 10. This arrangement reduces the susceptibility of the collector to exceptionally severe wind. With collector 69 positively retained with a relatively light retaining force, it may be easily removed for maintenance and repair.

FIG. 6(*a*) through 6(*d*) show an alternative embodiment of the deck rain diverter system which could be used in combination with the collector retaining system of FIG. 5. FIG. 6(*a*) shows a partial section of a U-shaped gutter 70 having regularly spaced mounting slots 74 formed therein. Mounting slots 74 are pre-formed on the opposed sides of gutter 70 and are periodically spaced along the length of the gutter at an interval sufficient to adequately support it. A mounting clip 76 may be formed from a plastic extrusion which is subsequently cut and drilled. Resilient tabs or fingers 78 are provided to captively mount the clips in the slots 74 while leaving them free to slide within the limits of the slots.

FIG. 6(*b*) shows a section of a convexly bowed collector component 80. The side edges of the collector are comprised of joist-contact regions 82 and notch regions 84 being defined therebetween. The contact regions provide a substantially continuous line of side edge support for the collector while the notch regions provide a slot-like opening for water to drain from the domed surface of the collector to the gutter 70. FIG. 6(*c*) shows a crosssectional view of gutter 70 attached to joist 10. Gutter 70 may be preformed according to the cross-sectional view of FIG. 6(*d*), such that the mounting clips 76 frictionally engage the joist to temporarily hold the gutter in position. When the gutter is set in final position with a desired pitch for draining water to the free end of the deck, it is attached with screws for permanent placement. The mounting clips are registered in the center of slot 74 to provide for limited movement of the gutter due to the large differential thermal expansion and contraction of plastic material from which the gutter may be formed. For metal gutters, where differential thermal expansion is negligible, the width of slot 74 may be the nominal width of bushing 76.

Collector 80 is pressed into a continuous linear contact with inclined flange 72 by the action of the collector retaining system of FIG. 5(*a*). The contact force at this interface is non-uniform, due to deformation of both the collector and the gutter. However, this effect is mitigated and the integrity of the joint is enhanced by placing the attachment point of the collector retaining system midway between the attachment points of clips 76 to the joists. The integrity of this joint may be additionally enhanced by making flange 72 more compliant relative to the stiffness of the total gutter 70 and the collector 80. If it is desirable to achieve a joint which is water-tight in a high wind environment, it can be achieved with the embodiment of FIGS. 6(*a*) through 6(*d*). For this embodiment, the preferred order of assembly is to first install the collector retaining system of FIGS. 5(*a*)–(*h*). Next the gutter mounting clips 76 are added to the gutter and the gutter is mounted to the joist. Finally, the collector 80 is snapped into position as shown in FIG. 6(*c*) in the manner described with reference to FIGS. 5(*f*) and 5(*g*).

FIG. 7(*a*) shows a perspective view of an alternative example of a gutter which is attachable to the bottom of joist. Attachment of gutter 90 is made by a screw inserted through slot 92. The length of slot 92 provides for differential thermal expansion as described earlier with reference to slot 74 of FIG. 6(*a*). While it would be possible to achieve a water-tight seal for this attachment, it is preferable that the shape of the gutter be modified to provide a dry region which positions the slot above the expected depth of water in the gutter. As shown in FIG. 7(*a*), a center island is a feature of the extrusion and is thus continuous. Alternatively, discrete islands may be added to gutter 70 of FIG. 6 to achieve the same result, with water flowing in the adjacent U-shaped troughs 93 and 95.

The embodiments considered thus far have employed gutters which must be semi-rigid to span the attachment points without sagging. It would be desirable to ship and otherwise handle gutters in a coilable form in the manner described with reference to FIG. 4 regarding coilable collector 32. To be coilable, the gutter must be designed with a relatively large transverse radius. Further, the attachment means must be adapted to work with this shape. FIG. 8 shows such an embodiment.

In FIG. 8(*a*) gutter 100 may be fabricated and coiled in the manner of FIG. 4, such that, when uncoiled, it snaps into a semi-rigid shape, as shown in FIG. 8(*a*). A mounting bracket 102 is attached to the underside of joist 10 as shown in FIGS. 8(*b*) and 8(*c*) by nails or screws passing through hole 105. Collector 100 is retained by tabs 104 on mounting bracket 102, which provide a supporting ledge. Collector retaining band 106 and spring 108 perform the same function as the collector retaining system of FIGS. 5(*a*) through 5(*h*). Thus, the collector may be installed and removed in the manner previously described.

Gutter 100 is pre-formed with apertures 110 (FIG. 8(*a*)), which are regularly spaced along the gutter at intervals sufficient to adequately support the gutter. Mounting brackets 102 are first mounted to the bottom of joist 10 by screws or nails passed through aperture 105 at an interval which nominally corresponds to the interval of apertures 110 in tabs 104. Next, gutter 100 is attached to bracket 102 by plastic or metal spring clips 114, a perspective view of which is shown in FIG. 8(*d*). The clips captures the edges of both aperture 110 in gutter 100 and slot 112 in tabs 104. Slot 112 allows for both the variation in the actual spacing of brackets 102 as well as relative movement due to thermal expansion. As such, gutter 100 can be a plastic material such as PVC having a high coefficient of linear expansion.

FIGS. 9(*a*) and 9(*b*) show yet another alternative for mounting the collector and gutter components to joists and provide substantially continuous support for the gutter, to thereby reduce the stiffness requirements of the gutter and improving the integrity of the collector/gutter interface. Mounting brackets, as at 120, attach to the lower end edges of joists 10 in the manner of bracket 102 of FIG. 8(*a*) Support members 124 are supported at each end by being engaged in horizontal slots 122. The substantially continuous support provided by support members 124 allows the gutter to be more flexible, thus making it easier to ship and install and less expensive to fabricate. Tabs 125 are spaced periodically along support member 124 to provide an edge stop for collector 32 such that the compressive force imparted by the collector retaining means positions the collector edge in intimate contact with gutter 126 to thereby improve the water-tight integrity of this interface and also to assure the retention of the gutter. For this embodiment, the preferable order of assembly is as follows: First mounting brackets 120 and support members 124 are installed in an alternating sequence along each joist. Next, the collector retaining means are installed between each opposing pair of mounting brackets followed by installation of gutters 126 (the relative order of these two steps are not important). Finally, collectors 32 are snapped into position, relying upon the elasticity of the collector retaining means to allow the edge of the collector to pass by the edge of support member 124 and be forced into the notch formed by tabs 125.

The embodiments considered thus far have comprised separate collector and gutter means to facilitated fabrication and installation of an impermeable assembly which does not compromise headroom because the joist cavity is used to crown the collector and thereby achieve the desired contour as shown conceptionally in FIG. 2. Alternatively, headroom may be conserved by employing a tensional-stressed pliable sheet to establish substantially the same contour. Since the pliable sheet acquires its shape through tension, it is not confined to the joist cavity and may span a plurality of joists. Thus, it is possible to control the contour of a relatively large sheet of pliable material to form peaks and valleys for collecting and draining away water passing between adjacent deck boards. If the geometry of the peaks and valleys is judiciously chosen, there will be a drainage path for each point on the pliable sheet and no puddles will form.

It is important to preclude the possibility of puddles, since the weight of any puddle increases the strain on the pliable sheet which may lead to an avalanche type of failure as the size of the puddle increases to further increase the strain. Also, in cold climates, ice formation can present a problem.

The requisite contour is achieved by a tensional stress on the pliable sheet sufficient to assure conformity to the contouring means. The underlying principle is illustrated in FIGS. 10(*a*)–10(*d*), which show several examples of strain along a line connecting a peak and a valley. FIG. 10(*a*) shows an ideal condition where the strain is negligible and the slope is constant. This ideal may be approached by increasing the yield strength of the pliable sheet and stressing the sheet near its yield stress to maintain the surface taught.

FIG. 10(*b*) shows an example where the weight of the pliable sheet causes an unacceptable strain. A catenary is formed, and the weight of the collected water adds to the strain, thus exacerbating the problem. One solution is to choose a material which is light in weight, has a low modulus of elasticity, and has negligible plastic deformation under stress. This may be best accomplished with a composite material comprising a high performance plastic film and a woven re-enforcing mesh. For example, a woven mesh of fiberglass or graphite could be imbedded between upper and lower layers of Mylar film.

Another solution is to increase the slope of the catenary as shown in FIG. 10(*c*). However, it is generally undesirable to do so since it reduces headroom which us usually at a premium. The preferable solution for a relatively large deck where headroom is important is shown in FIG. 10(*d*). Here, a plurality of peaks reduce the span of the catenary to control the droop such that complete drainage is accomplished without excessive slope. However, the location of the intermediate peaks must be chosen judiciously since an intermediate peak which provides drainage for one area may block the drainage of another area. A pliable sheet may be contoured to assure complete drainage by a peak-forming device which exerts an upward force on selected regions of the pliable sheet, a valley-forming member which exerts a downward force on other selected regions of the pliable sheet, and a tensioning means which determines the relative elevation of the regions of the pliable sheet which form a catenary between the peak-forming means and the valley-forming means.

FIGS. 11(*a*)–11(*d*) show one example of well chosen peaks and valleys. Valley-forming members 150, 152, 154, and 156 are mounted end-to-end along joists 10 at a slope sufficient to drain collected water to the exit edge. A large surface pliable sheet 151 is stretched across the valley forming members affixed to the underside of the joists and is retained in tension by a tensioning means (not shown). Peak-forming members, as at 158, are shown in cross-sectional detail in FIG. 11(*d*). It is comprised of a flexible tapered plate designed to place pliable sheet 151 in waterproof contact with the underside of joist 10 and provide stress relief by distributing the resulting upward force. FIG. 11(*b*) shows a cross-sectional view through peak-forming member 158, while FIG. 11(*c*) shows a cross-sectional view through peak-forming member 160. Peak-forming members 158–168 establish a watershed ridge wherein all water is constrained to flow into and along the valley-forming members 150–156.

FIG. 12(*a*) shows an cross-sectional view of a tensioning apparatus 178 while FIG. 12(*b*) shows the elements of the apparatus 178 in an exploded cross-sectional view. A portion of joist 10, to which 178, is attached, is shown in phantom line 12(*b*) for reference in FIG. 12(*b*). Tensioning apparatus 178 is comprised of an inner core member 180 which may be made of wood and which has been treated to inhibit rot. As shown in FIG. 12(*c*), barbed metal pins 182 are staked into inner core 180 at a periodic interval along its length and the resulting assembly is attached to joist 10 by screws 184. The interval between barbed pins is chosen to impart a substantially uniform tensional stress to the pliable sheet 192 after it has been impaled on the barbed pins. A spacer 204 may optionally be used to set the elevation of the tensioning means relative to the bottom of joist 10 and thus allow water to drain over the top. If the tensioning apparatus is used at the right side edge then pliable sheet 186 (FIG. 12(*b*)) is stretched to the desired tension, attached to the barbed metal pins and the excess material (indicated by the dashed line extension) is trimmed away. The same may be done to pliable sheet 188 to tension the left side edge. As shown, the tensioning apparatus 178 performs the function of tensioning and additionally joining two sections of pliable sheets 186 and 188 together.

A retaining clip 190 is pressed onto the inner core as shown in FIG. 12(*a*). It is designed to additionally stretch the pliable sheets 186 and 188 after they have been impaled on pins 182, compressively wrapping around inner core 180 to lock into the position shown in FIG. 12(*a*), and to provide a decorative cover. If required, retaining clip 190 may be additionally secured by screws. Retaining clip 190 may additionally function to provide a water-tight seal at the side walls of inner core 180.

FIG. 12(*d*) shows a partial plan view of a system employing tensioning apparatus 178 in various locations while FIG. 12(*e*) shows an end view of the same system. Joists 10 are shown in dotted lines for reference. Locations 194 and 202 are left-side-edge and right-side-edge tensioning means as previously described. When FIG. 12(*e*) is considered to be a cell of a wider system comprising a plurality of such cells, then the tensioning apparatus at locations 194 and 202 may additionally function as valley-forming devices. At location 198 the same means functions as a peak-forming device to establish a watershed ridge as previously explained.

Pliable sheet 192 may be continuous or, alternatively, may be spliced at any of the locations 194–202. Spacers 204–210 set the slope of the pliable sheet while allowing water to drain to the side edges as best seen in FIG. 12(*e*). Spacers 212 and 214 may be continuous along their respective joists to present a more attractive side-edge view.

For certain embodiments it is preferable to add a peak-forming means to a location intermediate of the joists after the pliable sheet has been attached. In this position, the elevation of the peak may have a wide range of adjustment to control the tension and shape of the pliable sheet. An example of such a devices is shown in FIGS. 13(*a*)–13(*e*). As shown in FIGS. 13(*a*), 13(*b*), and 13(*c*), a screw device 250 is joined to a plastic coated cord 254 by plate 252 to suspend the cord from the bottom of a deck board (not shown). Screw 250 is secured to plate 252 by crimping regions 253, while cord 254 is secured by crimping regions 255. A side view of a cleat 256 is shown in FIG. 13 (*c*), while a bottom view thereof is shown in FIG. 13(*d*). As shown in FIGS. 13(*c*) and 13(*d*), cord 254 passes through the center of cleat 256, and is laced in a conventional figure-eight pattern to provide an adjustable tensioning support for pliable collector sheet 257. Preferably, the interface of the pliable collector sheet 257, cleat 256 and cord 254 should be water tight. The free end of cord 254 may be tapered such that it may be readily threaded through an aperture of cleat 256 which would result in a interference fit, thus rendering this interface water tight. If required, a gasket may be added to seal the region between the pliable sheet and the cleat.

FIG. 13(*e*) shows a tool which may be used to attach screw 250 to the undersurface of a deck board between joists. The tool is comprised of a hollow tube 260 with slot 262 and handle 264. Cord 254 is threaded through tube 260 and the side edges of plate 252 engage slot 262. Pliable sheet 257 is pierced and screw 250 is driven into the deck board by the upward pressure and torque provided by tool 258 acting through plate 252. When the tool is withdrawn the free end of cord 254 will be accessible for attachment to cleat 256.

The aforementioned means for controlling the contour of the pliable sheet may be combined in a variety of ways to achieve complete drainage. FIGS. 14(*a*)–14(*d*) shows some illustrative examples. For each example arrows show the general direction of water flow. The actual direction of flow may vary due to the complex shape of the contour. The joist and end plate structure of the deck are shown as dashed lines for reference. The examples may also be considered as cells to be used in various combinations to extend the area of water collection.

With reference to FIG. 14(*a*), elements 300–308 are peak-forming devices while elements 310 and 312 are valley-forming devices which collectively create a contour for a pliable sheet in the manner explained of FIGS. 11(*a*)–11(*d*). The peak-forming means 300-308 establish a watershed ridge under joist 10 such that water flows transversely to the region of the valley-defining means and, thereafter, longitudinally to the exit edge as indicated by the arrows as at 313. FIG. 14(*a*) is considered to be a 2X cell in that the span of water collection is twice the joist-to-joist spacing. With reference to FIG. 14 (*b*), elements 320–328 are peak-forming devices, while elements 330 and 332 are valley-forming devices which create a contour for a pliable sheet in the manner of FIG. 11. Here, the watershed ridge is staggered to provide a 3X cell such as that described with reference to FIG. 10. The general direction of flow is transverse to the valley-forming regions followed by longitudinal flow along the valley-forming means as shown by the arrows 333. By combining 2X and 3X cells, a deck having any number of joist cavities can be accommodated.

FIG. 14(*c*) shows a 4X cell wherein element 340 is a continuous member which establishes a peak region, i. e., a ridge at center joist 10. Element 340 may be comprised of tensioning apparatus 178 as shown in FIG. 12(*a*). FIG. 14(*d*) shows a 4X cell which collects water to a single point at the exit end of valley-forming device 364. Element 362 is also a valley-forming device which functions to allow transverse water flow through it as shown by the arrows 363. Element 360 is a ridge-forming device in the manner of element 340. Elements 350–358 are adjustable peak-forming members as shown in FIG. 13(*c*). Valley-forming member 362 is attached to joist 10 such that each point along its length is at an elevation intermediate of the elevations of corresponding points along the top surface of element 360 and the bottom surface of element 364. Peak-forming members 350–358 reduce the span of the catenary to mitigate the formation of puddles as described with reference to FIG. 10, while element 362 assures that, in contrast to FIG. 14(*b*), the resulting ridge line has a saddle point at an intermediate elevation sufficiently low to completely drain all of the water from the right side and sufficiently high to discharge all of the collected water to the exit point. This condition is best satisfied when the height of peak-forming members 350–358 are adjusted to the minimum height necessary to insure complete contact between the impermeable sheet and valley-forming devices 362. Post-installation adjustment of the height of peak-forming means 350–358 is very advantageous in this embodiment since improper height adjustment can create blocking ridges and valleys. After installation, these conditions may be readily detected by testing and then corrected by adjustment.

In the embodiments considered thus far, the impermeable assembly has been comprised of discrete means which are collectors and gutters or alternatively continuous pliable sheet means which are contoured to form both collector and gutter regions. The embodiment of FIGS. 15(*a*)–15(*f*) shows an example of how elements of the discrete embodiments may alternatively be combined with a pliable sheet and its associated contouring, tensioning, and joining means. In this example the structure of FIGS. 9(*a*) and 9(*b*) has been modified to be used with a pliable sheet collector means in a 3X cell configuration. FIG. 15(*a*) shows an end view of the cell as installed. Gutter 400 corresponds to gutter 126 of FIG. 9(*a*) while gutter support plate 402 corresponds to bracket 124 of FIG. 9(*a*). Bracket 402 has been modified to provide attachment points for pliable sheet 404, as shown in the detailed section of plan view of FIG. 15(*b*) and the end view of FIG. 15(*c*). As shown, the bracket 402 is periodically cut and formed to create a pointed hook 408 which impales pliable sheet 404 to retain it in tension in the manner described with respect to the barbed pins of FIGS. 12(*a*)–12(*e*). The installation of the pliable sheet may be simplified, and the density of attachment points may be reduced if the side edge of the pliable sheet has a stress distributing cord 406 in a hem thereof. Alternatively, there are many other well known ways to perform this attachment.

With continued reference to FIG. 14(*a*), pliable sheet 404 is maintained in tension by means of flexible bracket 410 acting through wire link 412 and a flexible mounting pad 414 secured to sheet 404. Flexible mounting pad 414, shown in plan view in FIG. 15(*d*) and in end view in FIG. 15(*e*) is a circular rubber or plastic element which is suitably bonded to pliable sheet 404. Wire link 412 is threaded through eye 416 in pad 414. Elements 418 position pliable sheet 404 below the bottom surface of joists 10 to provide a transverse flow path in the manner of valley-forming means 150 of FIGS. 11$(b)_{13}$ and 11(*c*). In this embodiment, the height of flexible bracket 410 may be accurately established before the pliable sheet is completely installed. This may be accomplished by measurement from the bottom surface, or other feature of valley-forming means 418, or it may be set after the right-side edge of pliable sheet 404 has been installed as shown in FIG. 15(*f*). In this figure, flexible bracket 410 is shown in its light stress position. It is raised-to the elevation as shown, wherein, the installed portion of pliable sheet 404 is substantially taut and is fastened to joist 10. Installation is completed by fastening the left-side edge of pliable sheet 404 to mounting plate 402, thereby deforming flexible bracket 410 to the desired stressed state as shown in FIG. 15(*a*).

FIGS. 16(*a*)–16(3) show yet another alternative for mounting the collector and gutter components to joists and providing continuous support for the gutter, to thereby reduce the stiffness requirements of the gutter and improve the integrity of the collector/gutter interface. The mounting system is comprised of a pair of mounting rails 450 constructed according to FIG. 16(*a*), a two-piece bracket 452 for attaching the rails to the deck joists as shown in FIG. 16(*b*), and a collector retaining clip 456 as shown in FIG. 16(*c*). Each of these components may be readily realized using known plastic materials and thermo-forming processes. There are three essential features of rail 450. Apertures 458 provide vias for water to pass from the collector to the gutter. Projection 462 allows the rail to be captured by the two-piece bracket 452. Bracket 452 is comprised of a top piece 464 and a bottom piece 466, each having a mounting hole 468. Top piece 464 further includes elongated grooves or cavities 470 which receive the rail projections 462 therein. Bracket 452 can be attached at any point along rails 450 thus allowing the rails to run orthogonal to the joists without regard for the joist-to-joist interval.

FIG. 16(*d*) is a cross-sectional view through the center of the bracket 452 as mounted showing how rails 450 are captured by the compression of bracket pieces 464 and 466. FIG. 16(*e*) is a cross-sectional view through the center of rail aperture 458 and the center of collector retaining clip 456. The flexure and geometry of clip 456 is chosen such that when mounted as shown, the cop is held in a fixed position by tap 472 and exerts a downward force to retain collector 10. Retaining clips 456 may be located at any aperture and the clip-to-clip interval is chosen to assure continuous intimated contact between the gutter and the rail. The final assembly step is to snap gutter 470 into groove 460.

It would be desirable to enhance the transverse stiffness of the coiled collector of FIG. 4 while retaining the natural compliance of a relatively thin material. Well-known manufacturing processes may be used to corrugate, or otherwise add, a transverse rib structure to the collector, such that the transverse stiffness of the collector would be substantially greater than its longitudinal stiffness. FIGS. 17(*a*)–17(*c*) are illustrative of such a structure.

The embodiments explicitly disclosed are illustrative of the versatility of the individual elements, which may be employed in a wide variety of alternative configurations and combinations to most optimally achieve a desired combination of advantages. For example, various embodiments employing a pliable sheet may be less expensive and easier to install, while embodiments employing flexible or semi-rigid elements may be more durable.

While the invention has been described with embodiments intended to drain rainwater from deck structures, the benefits of an aesthetically pleasing ceiling system which is inexpensive and very easy to install is also desirable for dry or interior applications. Any of the disclosed embodiments could be used without modification in dry or interior applications. Further, it is intended that any of the disclosed embodiments may be appropriately modified for dry applications where impermeability is not required or for interior applications where environmental stress is relatively low.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A method for installing a water diverter structure to the underside of an elevated deck structure, said deck structure comprising a plurality of regularly spaced, longitudinally extending wooden joists, each having a first end affixed to a building structure and a second end supported by vertical posts and a plurality of deck boards affixed to and extending transversely to said joists, said method comprising the steps of:

(a) affixing a plurality of mounting brackets to facing side surfaces of adjacent ones of said joists along a line establishing a predetermined slope from a higher point proximate the first end of the joists to a lower point proximate the second end of the joists, said mounting brackets including slots therein;

(b) providing a plurality of thin, rectangular water impervious collector sheets of a width dimension greater than the spacing between adjacent joists;

(c) inserting a first longitudinal edge of the water collector sheets into the slots of the mounting brackets on one joist;

(d) manually compressing the water collector sheet in a transverse direction to establish a convex contour to an upper surface of the water collector sheet while inserting an opposed longitudinal edge of the water collection sheet into the slots in the mounting brackets on the facing side surface of an adjacent joist with the convex contour being retained upon release of the compression force;

(e) suspending a concave gutter member below each joist, the gutter member being in vertically overlapping relation to the longitudinal edges of the convex water collector sheets whereby water falling between the deck boards is diverted by the water collector sheets into said gutter members.

2. The method as in claim 1 wherein the gutter members are suspended from the mounting brackets on opposed side surfaces of each joist.

3. The method as in claim 1 wherein the water collection sheets are dispensed from a rolled coil during placement of opposed side edges thereof in the slots of mounting brackets affixed to opposed facing surfaces of an adjacent pair of joists.

* * * * *